US012270617B2

(12) United States Patent
Pellegrini

(10) Patent No.: US 12,270,617 B2
(45) Date of Patent: Apr. 8, 2025

(54) FIREARM FIRING CONTROL ASSEMBLY AND FIREARM OPTIC POSITIONING ASSEMBLY

(71) Applicant: Maia Pellegrini, Mesa, AZ (US)

(72) Inventor: Maia Pellegrini, Mesa, AZ (US)

( * ) Notice: Subject to any disclaimer, the term of this patent is extended or adjusted under 35 U.S.C. 154(b) by 0 days.

(21) Appl. No.: 18/223,380

(22) Filed: Jul. 18, 2023

(65) Prior Publication Data

US 2024/0027158 A1 Jan. 25, 2024

Related U.S. Application Data

(63) Continuation-in-part of application No. 17/869,688, filed on Jul. 20, 2022, now abandoned.

(51) Int. Cl.
*F41A 19/59* (2006.01)
*F41A 17/06* (2006.01)

(52) U.S. Cl.
CPC ..... *F41A 19/59* (2013.01); *F41A 17/06* (2013.01)

(58) Field of Classification Search
CPC ..... F41A 17/06; F41A 17/066; F41A 19/59; F41A 19/58; F41A 19/60; F41A 19/61; F41A 19/62; F41A 19/63; F41G 1/345
USPC ..... 42/70.11
See application file for complete search history.

(56) References Cited

U.S. PATENT DOCUMENTS 4,757,629 A * 7/1988 Austin ..... F41A 19/59 42/84
5,541,397 A * 7/1996 Walts ..... G06K 7/10881 250/221
6,464,554 B1 * 10/2002 Levy ..... A63H 5/04 250/221
10,962,320 B1 * 3/2021 Burdine ..... F41A 19/69
2006/0005447 A1 * 1/2006 Lenner ..... F41G 3/06 42/111
2007/0137470 A1 * 6/2007 Oertwig ..... F41A 19/58 42/84
2008/0060246 A1 * 3/2008 Rozovsky ..... F41A 17/46 42/70.07
2012/0141957 A1 * 6/2012 Miller ..... F41G 3/26 434/16
2017/0010067 A1 * 1/2017 Cosso ..... F41G 1/35
2018/0245869 A1 * 8/2018 Marin Tomás ..... F41A 19/59
2018/0328694 A1 * 11/2018 Hammond ..... F41G 1/30
2021/0140733 A1 * 5/2021 Herskowitz ..... F41G 3/08
2021/0318089 A1 * 10/2021 Burdine ..... F41A 19/69

* cited by examiner

*Primary Examiner* — John Cooper

(57) ABSTRACT

A firearm firing control system includes a firearm firing control assembly for touchless control of firing the firearm. The sensor is electrically connected to a power source and a load. When the sensor senses input (e.g., movement), an activation voltage from the power source causes the load to mechanically operate the trigger mechanism of the firearm. Circuit logic electrically resets the sensor, and the action of the slide mechanically resets the load.

14 Claims, 14 Drawing Sheets

152
155
156
166

152
155
167

152
155
157
160,162,163,164

152
155
166

FIREARM FIRING CONTROL ASSEMBLY AND FIREARM OPTIC POSITIONING ASSEMBLY

CROSS-REFERENCE TO RELATED APPLICATIONS

This application claims priority and the benefit of U.S. patent application Ser. No. 17/869,688, titled "Firearm Firing Control System and Red Dot Positioning Assembly", filed Jul. 20, 2022, and U.S. patent application Ser. No. 18/081,197, titled "Firearm Firing Control System and Red Dot Positioning Assembly" filed Dec. 14, 2022, the disclosures of which are incorporated herein by reference in their entirety.

TECHNICAL FIELD

The disclosure herein relates generally to a firearm firing control assembly and a firearm optic positioning assembly, as well as related methods.

Innovation and Competitive Advantage

A business is the result of immense hard work, dedication, and perseverance. However, this is not enough in a very competitive market. The key to success is the ability to adapt to change, respond to current market needs, and anticipate future market trends with the influx of fresh innovative ideas. Innovation adds value and is important for future growth, provides a competitive advantage, and distinguishes a business as a leader, not a follower. To be innovative a business must be willing to view problems differently and offer creative solutions. Innovation brings new products to market, provides consumers with purchasing options, and increases market share. To promote new value and growth it is important for businesses to have a vision and a willingness to invest in future technologies that may not be immediately evident.

The firearm industry that includes manufactures of after-market products such as optics is extremely competitive. Firearms and their development have contributed to the independence and freedom of many countries from invasion, occupation, and oppression of others. The right to bear arms is so important it is specified in the Constitution of the United States. Firearms may be used for many purposes including hunting, recreation (sport/target/training), security, law enforcement, and military operations, to name a few. These are areas where improvements in firearm technology is important and constantly evolving.

The firearm firing control assembly and the firearm optics positioning assembly as described herein offer not only a creative and innovative solution to the problem of improving shooting consistency and accuracy but may well provide a strategic and lifesaving approach to those injured in combat. Competitive shooters will find that the effortless use of a touchless trigger provides a relatively more consistent and accurate shooting experience when compared to "pulling the trigger." In a similar manner, the elderly or those with physical impairments that limit hand strength might be better able to adapt to a touchless trigger. The combination of the firing control assembly and optic positioning assembly of the firearm firing control system has potential in civilian applications as well as military applications having life and death consequences. The firing control assembly might allow a soldier to fire when wounded and otherwise unable to "pull the trigger". Likewise, the optic positioning assembly would allow the soldier to capture an image and to fire upon an enemy combatant without having to be in the line of fire.

The foreseeable uses and applications for the firearm firing control assembly and firearm optic positioning assembly are there for those with the vision to think outside the box and the willingness to explore creative possibilities in the evolutionary process of developing new and innovative firearm technologies.

BACKGROUND

Section 18 U.S.C. 921(a)(3) defines a firearm broadly to include "any weapon (including a starter gun) which will or is designed to or may readily be converted to expel a projectile by the action of an explosive." In this regard, firearms include handguns (e.g., revolvers and pistols) and long guns (e.g., rifles and shotguns).

Firearm safety is widely recognized as a very important element of handling and shooting a firearm. There are four universal firearm safety rules which, although often phrased in slightly different manners, are: (1) treat all firearms as if they are loaded; (2) always keep the muzzle of the firearm pointed in a safe direction; (3) keep your finger off the trigger until you have decided to shoot; and (4) be sure of your target and what is behind it. While these rules apply to the actions of the shooter, firearm safety is also a major consideration for firearm and accessory manufacturers. For example, some firearms include a manual safety, a trigger safety, a grip safety, a firing pin block, a de-cocker, and/or similar features for promoting safe handling and minimizing the risk of an accidental discharge.

While there are numerous operating methods for firearms, the basic principle of operation is the same. The firearm is loaded with a round and pressure is applied to a trigger (usually measured in pounds). The trigger is mechanically linked to various parts (referred to herein collectively as a trigger assembly), including in one example a trigger bar and a hammer under tension. Depressing the trigger (also often referred to as pulling or squeezing the trigger) moves the trigger bar and a sear to release the hammer tension, allowing the hammer to move freely to engage a firing pin which then strikes a primer on a casing of the round, causing a chain reaction within the casing leading to an explosion and subsequent discharge of a projectile from the firearm.

Factors that may affect the accuracy of hitting an intended target with the projectile include weather and other conditions over which the shooter has little control, as well as variables over which the shooter has some control such as stance, sight alignment and sight picture, recoil management, and trigger control. All the variables are interrelated to some degree and must be properly implemented to achieve consistency and/or accuracy in hitting the intended target. For example, a shooter may have proper body and hand positioning that creates a stable base and provides adequate recoil management of the firearm but be unable to establish proper sight alignment and sight picture and/or properly implement trigger control.

Sight alignment and sight picture have traditionally required alignment of the front and rear sights with each other, and alignment of the front sight on the intended target. However, with the use of relatively recent optic technology known as "red dot", the task of "sight alignment" can be simplified and in most cases replaced by ensuring the red dot of an optic is visible on the intended target. While use of red dot technology has greatly increased the consistency and accuracy of shooters there is a tendency by many shooters to hold the shot too longer looking for the perfect shot causing the red dot to move on and off the target. The combination of the trigger control system and optic positioning assembly disclosed herein solves this problem.

Proper trigger control can also greatly increase consistency and accuracy. The way the trigger is manipulated has a direct and dramatic effect on accuracy. Every shot taken is affected by the way the shooter pulls the trigger. This includes how the shooter depresses the trigger (gently, firmly, with a jerk, etc.), the amount of trigger pressure the shooter applies (light, moderate, heavy, etc.), the part of the finger the shooter uses (tip, crease, fatty area, etc.), whether the trigger pull is straight rearward or at some angle, and whether the trigger pull is smooth and steady. To improve trigger control, manufactures have designed firearms requiring less pressure to actuate the trigger. However, a shooter must still contend with all the aforementioned factors every time the shooter pulls the trigger.

Therefore, there is a need for a mechanism that helps manage trigger control by further reducing or eliminating the requirement of applying pressure to the trigger, and a mechanism to enhance consistency and accuracy in shooting.

SUMMARY

In accordance with one embodiment disclosed herein, firearm firing control system comprises a power source; a touchless sensor electrically connected to the power source; and a load electrically connected to the sensor and configured to be actuated by an actuation voltage from the power source upon detection of movement by the touchless sensor; wherein the load is configured to be mechanically connected to a trigger assembly of a firearm such that actuation of the load actuates a firing pin of the firearm, and may further comprises a firearm optic positioning assembly configured to be operatively connected to the firearm to capture multiple images of a field of view of an optic including a first image and generate a signal upon detection of a second image of the field of view being substantially the same as the first image.

Various embodiments of the subject matter described herein will become readily apparent to those skilled in the art from the following detailed description having reference to the attached figures, the subject matter described herein not being limited to any embodiment or example.

DETAILED DESCRIPTION

The invention relates to a firearm firing control system and related methods, and more particularly to a touchless sensor firing control assembly and a firearm optic positioning assembly to enhance shooting consistency and accuracy. Exemplary embodiments will be described with reference to the accompanying figures.

Figure 1:
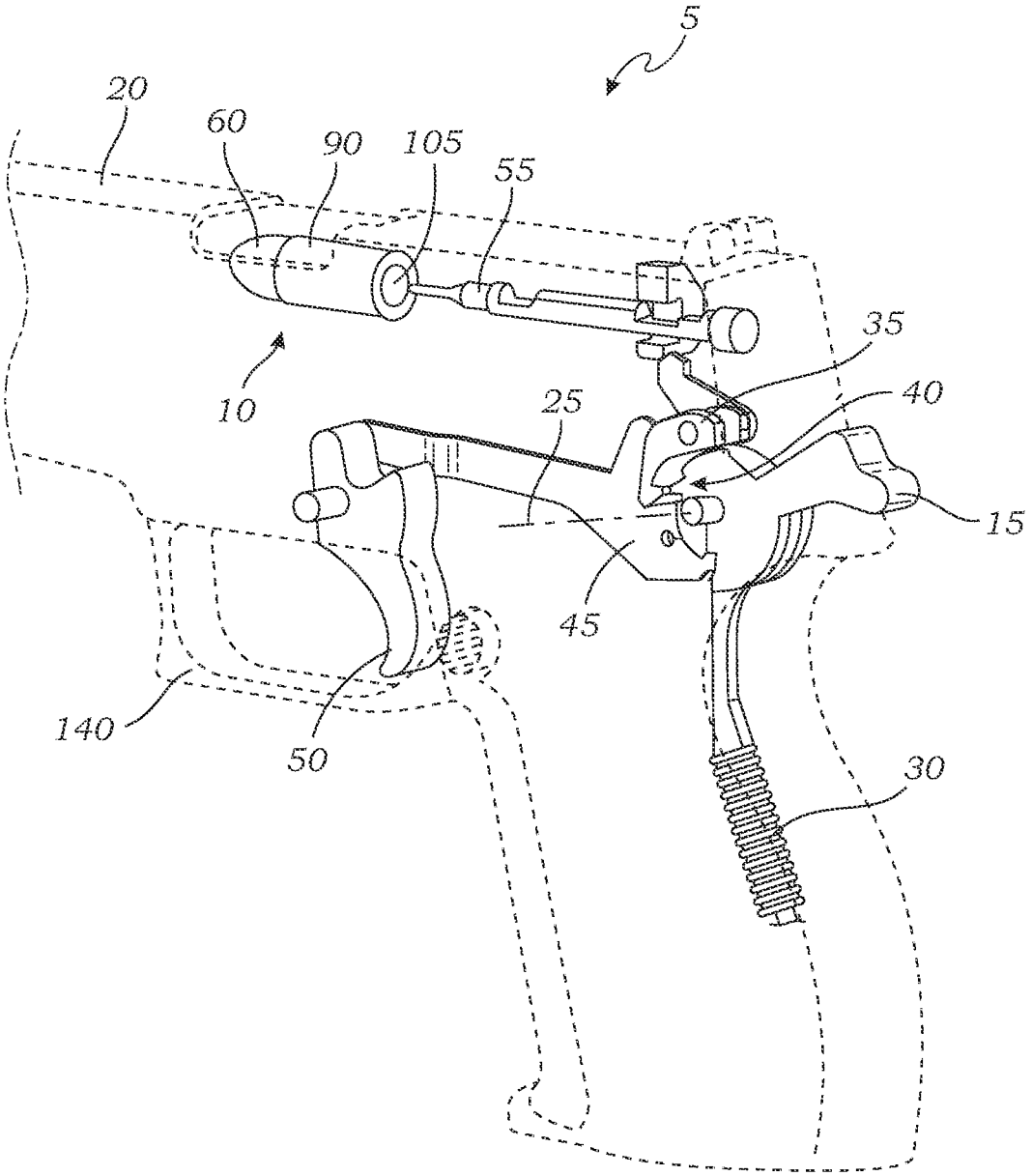
FIG. 1 PRIOR ART
FIG. 1 is a cut-away view of the mechanical components of a PRIOR ART hammer fire, semi-automatic handgun with a round chambered and the hammer cocked.

FIG. 1 shows an example of a firearm 5, in this regard, a hammer-fire, semi-automatic handgun, with a round 10 chambered and the hammer 15 cocked. Pulling back on the slide 20 engages the slide 20 with the hammer 15 causing the hammer 15 to rotate about a central axis 25. The hammer 15 is tensioned by a hammer main spring 30. Rotation of the hammer 15 permits a sear 35 to engage a notch 40 on the hammer 15 and retain the hammer 15 in a cocked position. A trigger bar 45 is connected between the trigger 50 and the sear 35. Some firearms may also include a sear disconnect, a firing pin block, an internal safety lever, or other components. However, in general, placing pressure on the trigger 50 moves the trigger bar 45 to disengage the sear 35 from the notch 40, allowing the hammer 15 to rotate and engage the firing pin 55. The hammer 15 forces the firing pin 55 to contact the primer 105 of the chambered round 10 causing an explosion within a casing 90 that retains a projectile 60. In addition to expelling the projectile 60 from the barrel of the handgun 5, the force of combustion forces the slide 20 back to eject a spent casing 90, cock the hammer 15, and reset the internal mechanics of the handgun 5 before the slide 20 then either moves forward due to spring tension, chambering another round 10, or remains locked back in a slide-lock position if no more rounds 10 are available in the magazine to be chambered.

Figure 2:
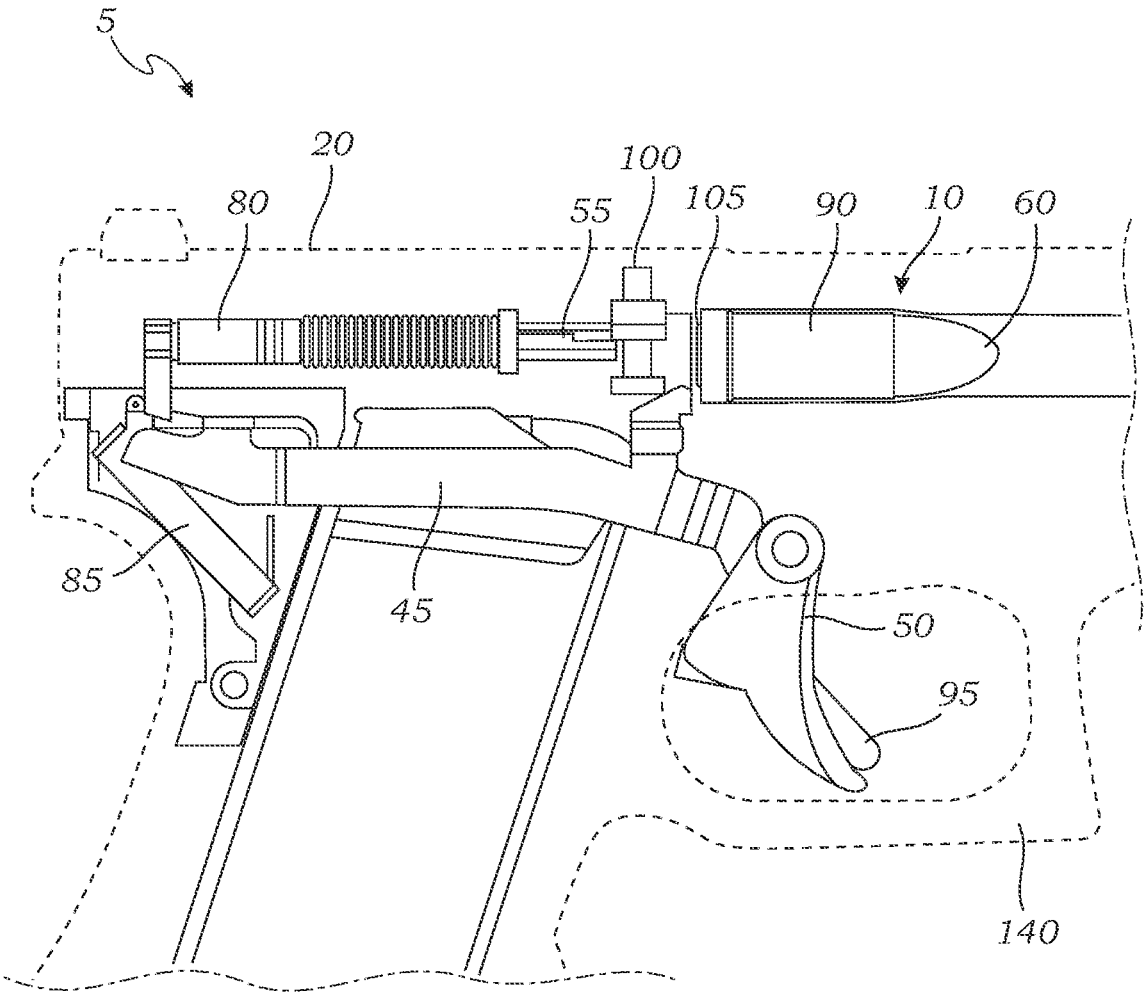
FIG. 2 PRIOR ART
FIG. 2 is a cut-away view of the mechanical components of a PRIOR ART striker fire, semi-automatic handgun with a round chambered.

FIG. 2 shows another example of a firearm 5, in this regard, a striker-fire, semi-automatic handgun, with a round 10 chambered. While the internal features of the striker-fire handgun shown in FIG. 2 differ from the internal features of the hammer-fire handgun shown in FIG. 1, the basic operation of pulling a trigger 50 to move a trigger bar 45 to allow a firing pin 55 to contact a primer 105 of a chambered round 10 is similar.

More specifically, as shown in FIG. 2, the trigger bar 45 engages the striker 80 to prohibit the firing pin 55 from contacting the primer 105 of the chambered round 10. As the trigger 50 is pulled, a connector 85 engaged with the trigger bar 45 forces the trigger bar 45 downward to release the striker 80 from engagement with the trigger bar 45. Since the striker 80 is under spring tension, disengaging the striker 80 from the trigger bar 45 pushes the striker 80 forward causing the firing pin 55 to contact the primer 105 of the chambered round 10. The ensuing explosion expels the projectile 60 from the barrel of handgun 5, and forces the slide 20 back to eject a spent casing 90 and reset the internal mechanics of the handgun 5, including a reset and engagement of the trigger bar 45 with the striker 80 before the slide 20 moves forward and chambers another round 10 (or remains in slide-lock if no more rounds 10 are available). FIG. 2 also shows two elective safety features including a trigger safety 95 and a firing pin safety 100.

Regardless of the type of firearm, the basic structure and process for operating a fireman is similar across all platforms. A shooter must apply pressure to a trigger 50 to release a firing pin 55 that contacts the primer 105 of a round 10 leading to an explosion and a projectile 60 then being expelled from the firearm 5. Thus, proper trigger control is an important consideration in maintaining consistent and accurate shooting, and any feature of a firearm that improves trigger control is valued.

Figure 3:
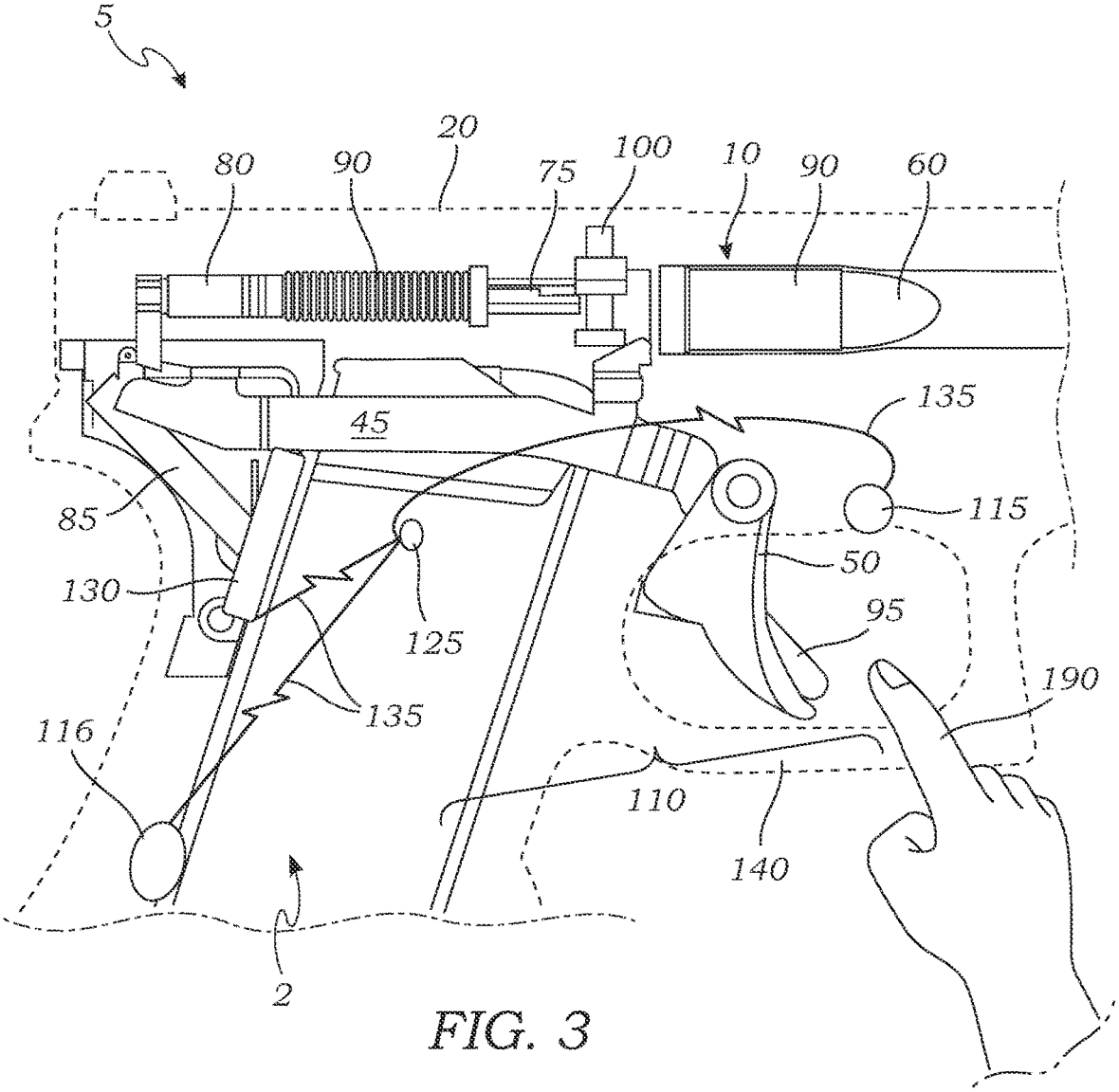
FIG. 3 shows the handgun of FIG. 2 with the addition of a touchless firearm firing control assembly forming a firearm firing control system in accordance with an embodiment of the present invention.

FIG. 3 shows the hammer-fire firearm 5 of FIG. 2 further including a touchless firearm firing control assembly 110 in accordance with an embodiment disclosed herein. The firearm 5 and the touchless firing control assembly 110 in combination represent a firearm firing control system 2. The firearm 5 shown in FIG. 3 includes the trigger 50, the trigger bar 45, the connector 85, the striker 80, and the firing pin 55, with a chambered round 10, as generally shown in the handgun 5 of FIG. 2. The firing control assembly 110 shown in FIG. 3 includes a sensor 115, a power source 116, a power on/off switch 125, a load 130 (shown as an electro-mechanical linkage), and mechanical/electrical connectivity 135 between the sensor 115, power source 116, power switch 125, and load 130. The size, dimensions, operating characteristics, positioning, and combination of the elements of the firing control assembly 110 may differ for various firearms. As such, each firearm should be assessed for practical application of the subject matter disclosed herein.

Sensor 115

Various types of sensors 115 may be used. One example is a proximity sensor that detects movement or presence of an object 190 without making physical contact with the object 190, then converts the information of detected movement or presence into an electrical signal. In other words, a proximity sensor is a touchless sensor for the detection of object movement. With firearms, the relevant object 190 moving is typically a finger (as shown in FIG. 3) or more precisely, a portion of a finger, and the relevant movement is typically movement within the trigger guard 140. A proximity sensor can sense the presence of the object 190 (e.g., a finger) by sensing object movement in the sensor's coverage zone, which may vary for different sensors based on manufacturer specifications or may even be adjustable. The coverage zone may entail parameters such as distances in x-axis, y-axis, and z-axis directions (measured in straight lines or curves) and/or sensitivity. In response to detection of such movement, the proximity sensor sends or allows to pass an electrical signal to a load 130. There are many types of proximity sensors, and each detects the presence of an object 190 in a unique way. In the touchless sensor firing control assembly 110 shown in FIG. 3, the sensor 115 may be embodied as a proximity sensor including a photoelectric sensor, a capacitive proximity sensor, or a similar sensor.

A photoelectric sensor is used to detect the presence or absence of an object 190 or for measuring the distance between a point and an object using a light. A photoelectric sensor consists of an emitter such as a light emitting diode (LED) or laser diode for emitting light and a receiver such as a photo diode or photo transistor for receiving the light. Depending on the type of photoelectric sensor, the emitter and receiver may be housed in separate units, or the emitter and receiver may be housed in the same unit. The emitter converts an electrical signal from a power source to light energy such as a beam of visible light or infrared light. When the emitted light is interrupted, as in a thru-beam sensor, or reflected/diffused, as in a retro-reflective or diffuse-reflective sensor respectively by the object 190, the amount of light that arrives at the receiver is changed. The receiver detects the change in light amount and converts it to a digital output of either of an "on" or "off" switched output state.

With a photoelectric sensor the terms "light on" and "dark on" are used to define what the sensor output is doing in the absence or presence of light at the receiver of the photoelectric sensor. In the "light on" mode the output from the sensor turns on when the receiver detects light from the emitter whereas in the "dark on" mode the output from the sensor turns on when the receiver detects no light from the emitter. The sensor output to a load may be a positive voltage (PNP or source output) or a negative voltage or ground (NPN or sink output). As disclosed herein, the output of the photoelectric sensor may be electrically connected to a load 130 such as the electro-mechanical linkage shown in the drawings, to induce a mechanical action.

A capacitive proximity sensor is based on the principle of a parallel plate capacitor. A parallel plate capacitor consists of two parallel plates separated by a dielectric material. Once connected to a power source 116, an electric field is created as the parallel plates become oppositely charged creating an electric field between the plates that holds a capacitive charge. The ability of a capacitor to store electrical charge when a voltage is applied is called capacitance. The capacitance of a capacitor is directly proportional to the ability of the dielectric material between the two charged plates to store a charge, known as the dielectric constant, and inversely proportional to the distance between the two plates.

A dielectric-type capacitive proximity sensor can detect any object 190 including a finger that has a dielectric constant greater than air. The dielectric capacitive sensor has two parallel plates linked to an oscillator and a detector circuit acting as a switch inside the sensing head that operate like an open capacitor with air acting as the dielectric. When no object is present the capacitance between the plates will be at a low initial value. However, when an object 190 such as a finger having a dielectric constant greater than air is in proximity to the plates, i.e., the sensor detects object movement, the capacitance between the plates increases. An increase in capacitance increases the amplitude of oscillations in the oscillator. When the amplitude exceeds a specific value, the detector produces an electrical output. With a capacitive proximity sensor, the terms "normally open" or "normally closed" are used to define the sensor output when an object 190 is detected. As disclosed herein, the output of the capacitive proximity sensor may be electrically connected to a load 130 such as the electro-mechanical linkage shown in the drawings, to induce a mechanical action.

Figure 4:
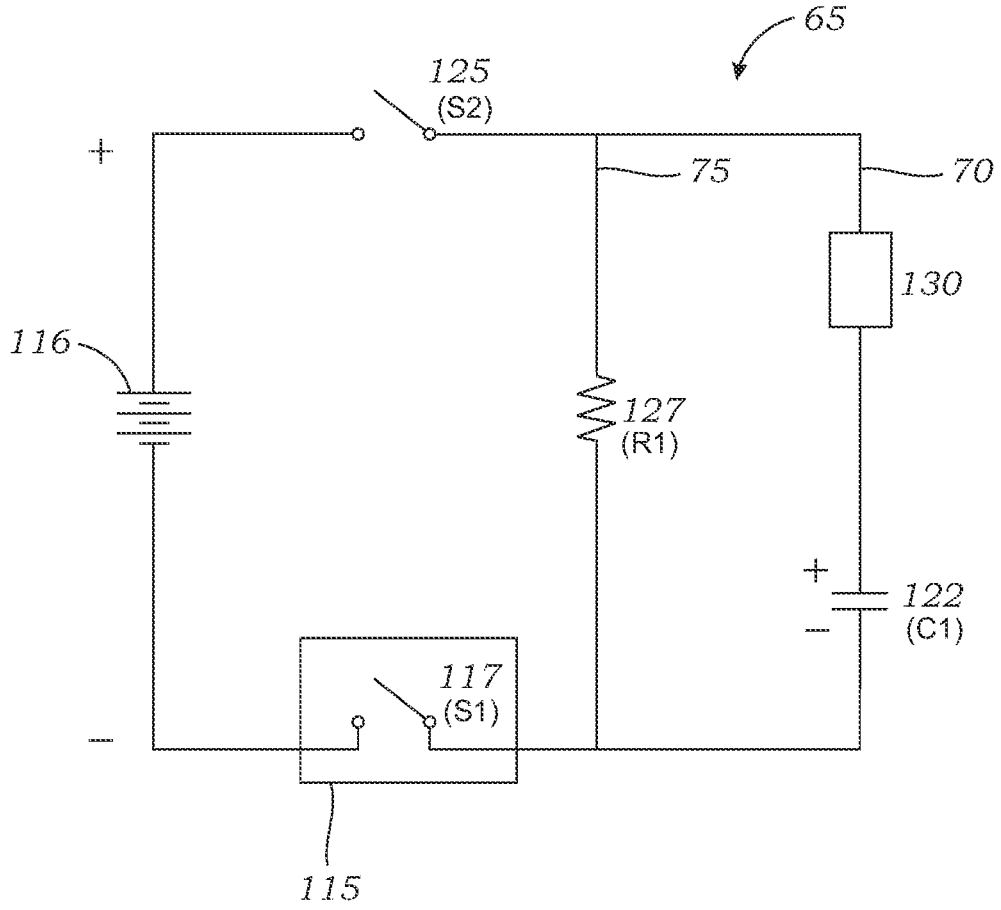
FIG. 4 shows a circuit diagram of a touchless sensor firing control assembly in accordance with an embodiment disclosed herein.

Turning to FIG. 4, a basic circuit 65 is shown for the sensor assembly 110 in accordance with an embodiment disclosed herein. FIG. 4 shows representative examples of the power source 116 including positive and negative terminals, the sensor 115, an internal detector switch 117 of the sensor 115 for detection of an object 190, the load 130, and a power switch 125. The circuit further includes a capacitor 122 and resistor 127. The capacitor 122 and load 130 form a circuit branch 70 in parallel with a circuit branch 75 containing only the resistor 127.

In one example of circuit operation, the power switch 125 used to selectively engage or disengage the sensor assembly 110 is placed to an "on" position or engage position to apply power to the sensor 115. With power being supplied to the sensor 115, if an object 190 is detected by the sensor 115, an internal detector switch 117 closes, thus completing the circuit 65 such that voltage from the power source 116 is distributed equally across parallel branches 70 and 75 of the circuit 65. Initially, no voltage potential appears across the capacitor 122. In one example, if the power source 116 is a 9-volt battery, after completing the circuit 65, a 9-volt potential is placed across the resistor 127 and load 130, and no voltage potential is placed across the capacitor 122. The voltage from the power source 116 applied to the load 130 is equal to or greater than the activation voltage required to activate the load 130. As such, after completing the circuit 65, an activation voltage is applied to the load 130 causing directional movement of the load 130 thus causing the firing pin 55 to strike the primer 105.

As current flows through the parallel branches 70, 75 of the circuit 65, the capacitor 122 is charged. The charge on the capacitor 122 opposes current flow. As current flow is reduced through circuit branch 70, the voltage across the load 130 is correspondingly reduced to a level below the activation voltage. The charge on the capacitor 122 continues to rise until current ceases to flow in circuit branch 70. As the load 130 no longer has the activation voltage applied, cycling of the slide 20 on the firearm 5 mechanically resets the trigger bar 45.

With the capacitor 122 fully charged and both the power switch 125 and the internal detector switch 117 closed, current flows only in circuit branch 75. The steady state of the circuit 65 is maintained until either the power switch 125 or the internal detector switch 117 is opened. In one example, removing the object 190 from the coverage area of the sensor 115 opens the internal detector switch 117. With the internal detector switch 117 open, the capacitor 122 discharges. In this regard, the potential across the capacitor 122 is discharged across the resistor 127 and the load 130. In one example, the resistor 127 is of a sufficient resistive value so that the voltage across the load 130 remains below the actuation voltage. With the internal detector switch 117 open and the capacitor 122 discharged, no current flows in the circuit 65 and all voltages remain at zero volts until the internal detector switch 117 is closed by detection of an object 190. At that time, the load 130 again receives an activation voltage from the power supply 116, and the cycle repeats.

In summary, when a shooter places a finger in the presence of the proximity sensor, as may by the case when placing a finger in the trigger guard, the firearm will fire, and the slide will re-cycle and reset the trigger bar in the normal manner. Regardless of how long the finger remains in the presence of the sensor, the firearm will only fire once. In this regard, the finger must be moved from the coverage zone of the sensor and again moved into the coverage zone to allow a new detection of the finger by the sensor before the firearm once again fires. The firearm will fire each time the sensor detects the action of moving the finger in-and-out of the coverage zone. Placing the power switch 125 into an "off" position will open the power switch 125 to disengage the firing control assembly 110 and allow the trigger 50 to function in the traditional manner.

While a photoelectric sensor (including an ultra-minute/miniature photoelectric sensor) and a dielectric-type capacitive sensor are types of proximity sensors that may be considered as sensors 115 for the detection of the presence or absence of an object 190 such as a finger within a trigger guard 140 of a firearm, other sensor types may also be appropriate. Likewise, the physical properties including size, weight, and durability, as well as the electrical properties including input and output voltages, current handling capabilities, detection sensitivity, and other considerations of any sensor 115, may be selected based on a variety of factors including the space limitations for positioning within the firearm as well as operational compatibility with other elements of the touchless sensor firing control assembly 110.

Figure 5:
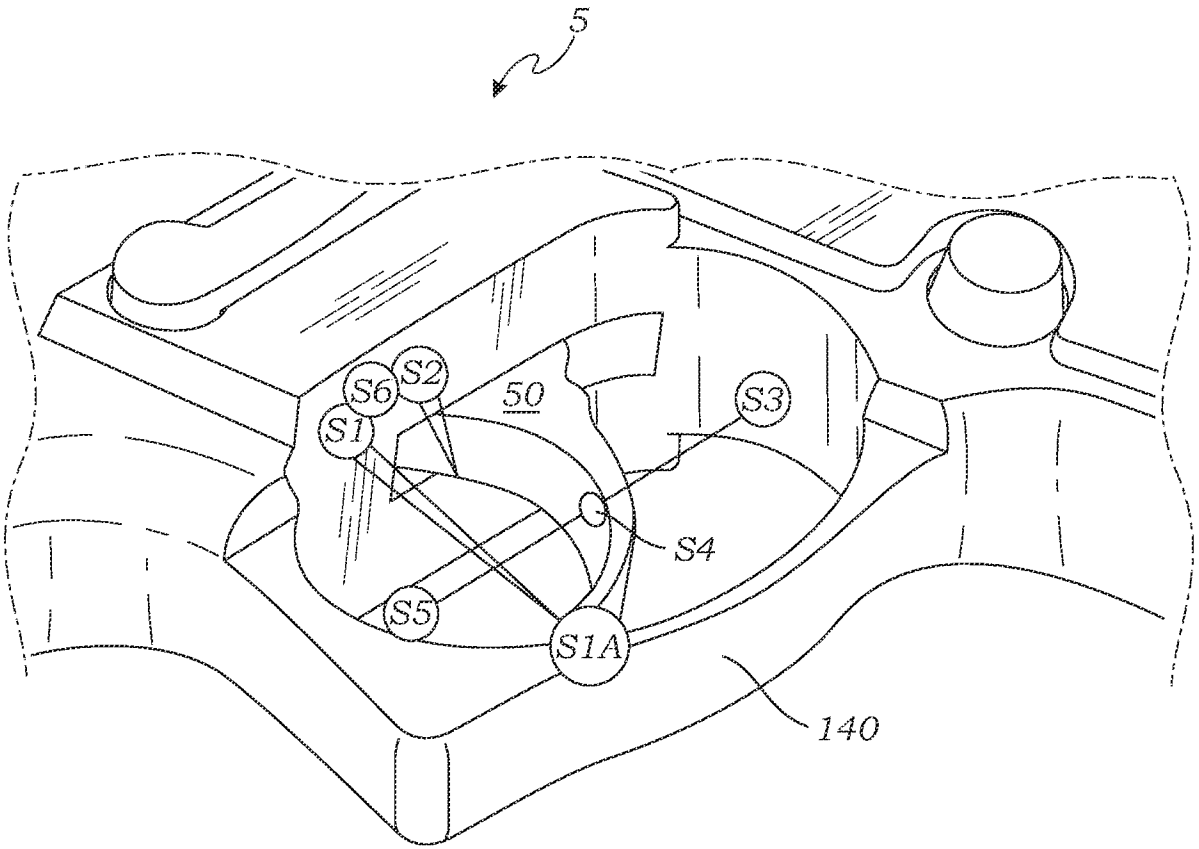
FIG. 5 shows various locations on a firearm where sensors of the touchless sensor firing control assembly may be placed in accordance with certain embodiments as disclosed herein.

Turning now to FIG. 5, a trigger guard 140 of a firearm 5 is shown with examples of possible locations (S1-S6) for one or more proximity sensors 115 to be placed. These examples allow detection of the presence of an object 190 within the coverage zone of sensor(s) 115, for example directly in front of the trigger 50 or within the trigger guard 140. The locations shown are representative and not intended to show the exact location of any sensor(s) 115. In this regard, location S1 is a possible location for a retro-reflected sensor 115 having a reflective substance (S1A) positioned opposite to reflect a beam projected from an emitter of the sensor 115 back to a receiver of the sensor 115. Location S2 is a possible location for a diffuse-reflective sensor 115 in which the projected beam from an emitter of the sensor 115 is reflected by the detected object 190 back to a receiver of the sensor 115. Location S3 is a possible location of a thru-beam sensor 115 projecting a beam from an emitter of the sensor 115 through an orifice S4 formed in the trigger 50 of the firearm 5 to a receiver S5 positioned in alignment with the beam from the emitter of the sensor 115. Location S6 is a possible location of a dielectric-type capacitive proximity sensor 115.

The size, shape, and/or configuration of any trigger guard or housing 140 and trigger 50 should be considered in determining the actual type of sensor 115 used and its location relative to the trigger guard 140. For example, a flat trigger, a curved trigger, and a trigger having a trigger safety may each offer certain advantageous or disadvantages in one instance when compared to the alternative trigger options.

In one embodiment, multiple sensors 115 with multiple corresponding detector switches 117 are used such that multiple detections of movement in multiple corresponding locations are required to activate the corresponding switches 117 and complete the circuit 65. For example, a first sensor 115 may be configured to detect movement within the trigger guard 140, and a second sensor 115 may be configured to detect movement in the grip of the firearm 5. Logic circuitry may be preprogrammed, programmable, or user-adjustable to set a certain time period within which the two movements must be detected relative to each other to activate the corresponding switches. For example, if a first sensor 115 detects movement, and the second sensor 115 detects movement within 0.5, 1.0, 1.5, 2.0, 2.5, 3.0, 3.5, 4.0, 4.5, or 5.0 seconds, or any other suitable time period, that would be indicative of the shooter intending to fire the firearm 5. Alternatively, the time period may be dependent on which sensor 115 senses movement first. For example, if the first sensor senses movement in a zone of coverage at the back of the handgrip, indicating the firearm is in the shooter's hand, the time period may be set to effectively infinity (or constantly reset) until the first sensor 115 detects another movement (e.g., removal of the hand from the handgrip), thus converting the logic circuit to effectively the single sensor embodiment in which the actuation voltage is sent to the load 130 upon detection of movement by the second sensor 115. In this two-sensor embodiment, the actuation voltage will not reach the load 130, and thus the trigger bar 45 will not be actuated to release the firing pin unless motion is detected in both zones of coverage within the applicable time period. This configuration could be used as an extra safety measure in suitable implementations of the invention.

Power Source 116

Power source 116 connects electrically to the sensor 115 to provide a supply voltage to the sensor 115. As shown in FIG. 4, upon activation of the sensor 115 (due, e.g., to detection of the presence of an object 190), the sensor 115 outputs the supply voltage from the power source 116 to the load 130. Voltage requirements for the sensor 115 and sensor output voltage may vary depending on the type of sensor 115 utilized, operating parameters of the sensor 115, and voltage requirement of the load 130. Choice of power source 116 may also take into consideration size and space limitations of the firearm 5 for placement of the power source 116. In this regard, suitable power sources 116 may include, but are not limited to a 3V ENERGIZER 1632 lithium battery, a 3V CR 2032 LiCB battery, a CR123A 3v Lithium battery, a 28 A DURACELL 6V battery, or an A23 12V battery.

The power source 116 may be a dedicated power source or may be shared with other components. For example, many firearm's 5 use a red dot optic sighting device that typically includes a battery to provide power to generate the red dot optical beam. While some modification of the red dot device may be required, in some applications it may be suitable to electrically connect and utilize the battery of the red dot optic to supply power to the sensor 115.

Load 130

Load 130, for example an electro-mechanical linkage, is operatively connected to the trigger bar 45 to allow the firing pin 55 to engage the primer 105 once the load 130 receives the actuation voltage from the sensor 115. In this regard, the load 130 is electrically connected to the sensor 115 and power source 116, and operatively connected to the fire firearm 5 upon detection of object movement by the sensor 115. More specifically, the load 130 may be a linkage electrically connected to the sensor 115 that receives an activation voltage from the sensor 115 upon detection of an object 190 by the sensor 115, and mechanically connected to the trigger assembly of the firearm 5 to disengage the firing pin 55 to fire the firearm 5. Typically, the load 130 will be connected directly to the trigger bar 45.

The load 130 (typically electro-mechanical linkage) may be a solenoid, a spring, a relay, a moveable arm/plunger, or any suitable device that can receive an electrical input such as supply voltage and provide a mechanical output. For example, a solenoid includes a coiled wire having a central core for positioning of a plunger (linkage). When a voltage is applied to the coil a magnetic field is created that causes a directional movement of the linkage. In another example, power is applied to a small DC motor to cause rotary motion in an armature that is mechanically linked by one or more gears of the linkage to cause directional movement of the linkage. In still another example, a relay having a control circuit that receives power to create a magnetic field to attract or repel a magnetic arm provides directional movement to a linkage. In each example, a spring or the movement of the slide in combination with the circuit configuration as shown in FIG. 4 is used to return the load 130 to a reset position.

The mechanical output of the electro-mechanical linkage 130 is a directional movement of sufficient force to disengage the trigger bar 45 from engagement with the firing pin 55 or the striker 80 to allow the firing pin 55 to engage the primer 105. After the primer 105 ignites and an explosion occurs, the energy of the explosion forces the slide 20 backward and then the energy of a recoil spring forces the slide 20 forward to chamber another round 10, reset the slide 20, and reset positioning of the electro-mechanical linkage 130 relative to the trigger bar 45. The cycle of the output voltage from the sensor 115 to the electro-mechanical linkage 130 upon detection of an object 190, mechanical motion of the electro-mechanical linkage 130 to disengage the trigger bar 45, and reset of the slide 20, the trigger bar 45, and the electro-mechanical linkage 130, repeats during operation of the firearm 5, or remains in slide-lock if no more rounds 10 are available.

Power Switch 125

Touchless firing control assembly 110 may be disabled so as not to affect normal operation of the firearm 5. With the assembly 110 disabled, the shooter can apply pressure to the trigger 50 and the firearm 5 will operate as mechanically designed without interference by the firing control assembly 110. This is accomplished by use of the power switch 125 that allows the shooter to selectively engage/disengage the firing control assembly 110. In the OFF position, the power switch 125 opens the circuit 65 so the electrical connectivity 135 between the power source 116, sensor 115 and load 130 is broken or interrupted.

The touchless firearm firing control assembly 110 may be selectively engaged and disengaged with the power switch 125. Design of the circuit 65 and the ability to selectively engage the control assembly 110 offers the shooter a variety of ways to fire the firearm 5. In this regard, with the power switch 125 in the OFF position, the touchless firearm firing control assembly 110 is inoperable. As such, in the OFF position the power switch 125 functions as a safety mechanism to prevent accidental discharge of the firearm in a touchless manner. Accordingly, the firearm is operated or fired in a traditional manner by pulling the trigger.

With the power switch 125 in the ON position the firearm 5 may be fired in a touchless manner or in the traditional manner using the trigger 50. For example, with the control assembly 110 operational, placement of a finger 190 into the trigger guard 140 permits touchless firing control of a first shot from the firearm 5. Subsequent shots may be fired using the touchless firing control assembly 110 by moving the finger 190 in-and-out of the coverage zone of the sensor 115. Alternatively, the second shot or any follow-up shots may be fired using the trigger or in a touchless manner using the touchless firing control assembly 110. Accordingly, the power switch 125 and circuit 65 of the touchless firearm firing control assembly 110 provide an enhanced level of safety while offering the shooter a variety of firing options in operation of the firearm 5.

Mechanical and Electrical Connectivity 135

Mechanical connections and/or electrical connectivity 135 are provided between the elements of the sensor assembly 110 including the sensor 115, power source 116, power switch 125, and load 130, as required for selective operation of the touchless firearm firing control system 2. Hardware such as fasteners, nuts, washers, seals, etc., as well as solder joints and other common elements used in forming connections between elements are not shown but are well-known.

DC Generator Power Source

Figure 6:
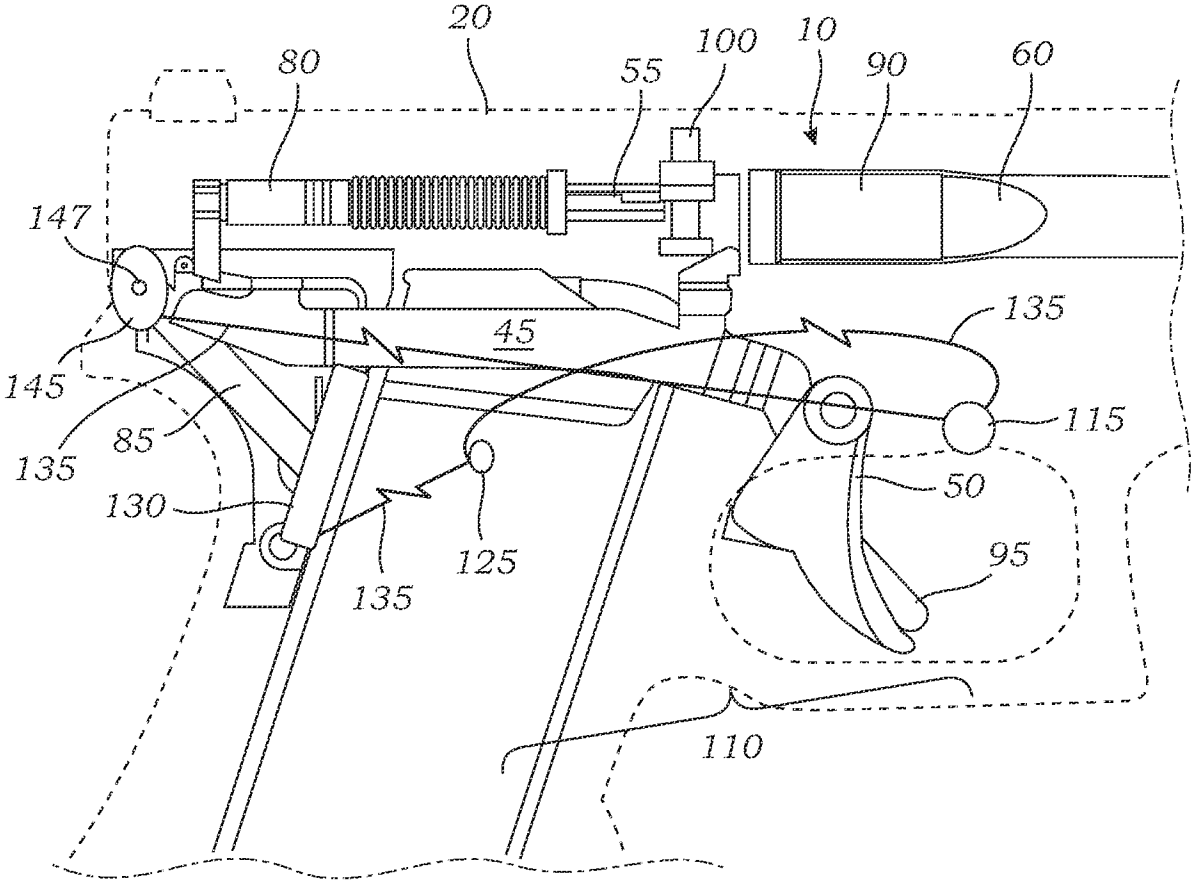
FIG. 6 shows a direct current (DC) generator operatively connected as a power source to a touchless firing control assembly in accordance with an embodiment disclosed herein.

While a battery is a suitable power source 116 for powering the sensor 115 and providing the actuation voltage to the load 130, the linear mechanical motion of the slide 20 or rifle bolt moving back and forth during normal operation may be converted into electrical energy through the rotation of an armature 147 of a direct current (DC) generator 145 to charge the sensor 115 such as the dielectric-type proximity sensor. In this regard, FIG. 6 shows a representation of a direct current (DC) generator 145 operatively connected as the power source 116 in the touchless firearm firing control system 2.

Armature 147 of the DC generator 145 is mechanically connected to receive the mechanical input from the slide 20 as the slide 20 is moved back-and-forth during the initial manual loading of a round 10 into the chamber of the firearm 5 (racking the slide) or during normal operation of the firearm 5 as the energy from the explosion of firing a round 10 is released. The DC generator 145 may be connected to the slide 20 in a variety of ways to impart the mechanical motion of the slide 20 to the armature 147 of the DC generator 145. For example, friction between the slide 20 and the armature 147 rotates the armature 147, serrations on the bottom of the slide 20 mate with teeth on a gear positioned on the armature 147 to rotate the armature 147, or a coiled wire attached to the armature 147 and connected to the slide 20 is extended and recoiled through material memory to rotate the armature 147.

The DC generator 145 is electrically connected to the sensor 115. Rotation of the armature 147 produces an instantaneous electromagnetic force (EMF) or "e" equal to B•l•v• sin Ø, where "B" is strength of the magnetic field, "l" is the length of conductor cutting the lines of magnetic force, "v" is velocity of the conductor, and "sin Ø" is the angle of conductor to the lines of magnetic flux.

The dielectric-type proximity sensor 115 is essentially a capacitor. As such, the EMF of the DC generator 145 electrically connected to the sensor 115 charges the dielectric-type proximity sensor 115 to a sufficient charge for operation of the load 130. The energy stored in the sensor 115 is discharged or released to the load 130 through an electrical connection with the sensor 115 when the sensor 115 detects the presence or absence of an object 190 such as a finger. The load 130 is operatively (mechanically) connected to the trigger assembly of the firearm 5 (typically to the trigger bar 45) to disengage the trigger bar 45 allowing the firing pin 55 to engage the primer 105 to cause an explosion and release the energy stored in the casing 90. The explosion and release of energy causes the slide 20 to move back-and-forth and the sensor 115 to be charged as the cycle of energy charge/discharge repeats during operation of the firearm 5.

A battery will provide a relatively constant source of power as required to maintain activation of a beam in a photoelectric proximity sensor; however, a dielectric-type proximity sensor does not project a beam, so a continuous power source is not required. A charge on the dielectric-type proximity sensor is only required prior to the touchless detection of presence or absence of an object. Use of a DC generator 145 to periodically convert mechanical energy to electrical energy may be a suitable alternative power source to a battery.

Firearm Optics Positioning Assembly/Red Dot Positioning Assembly

Figure 7:
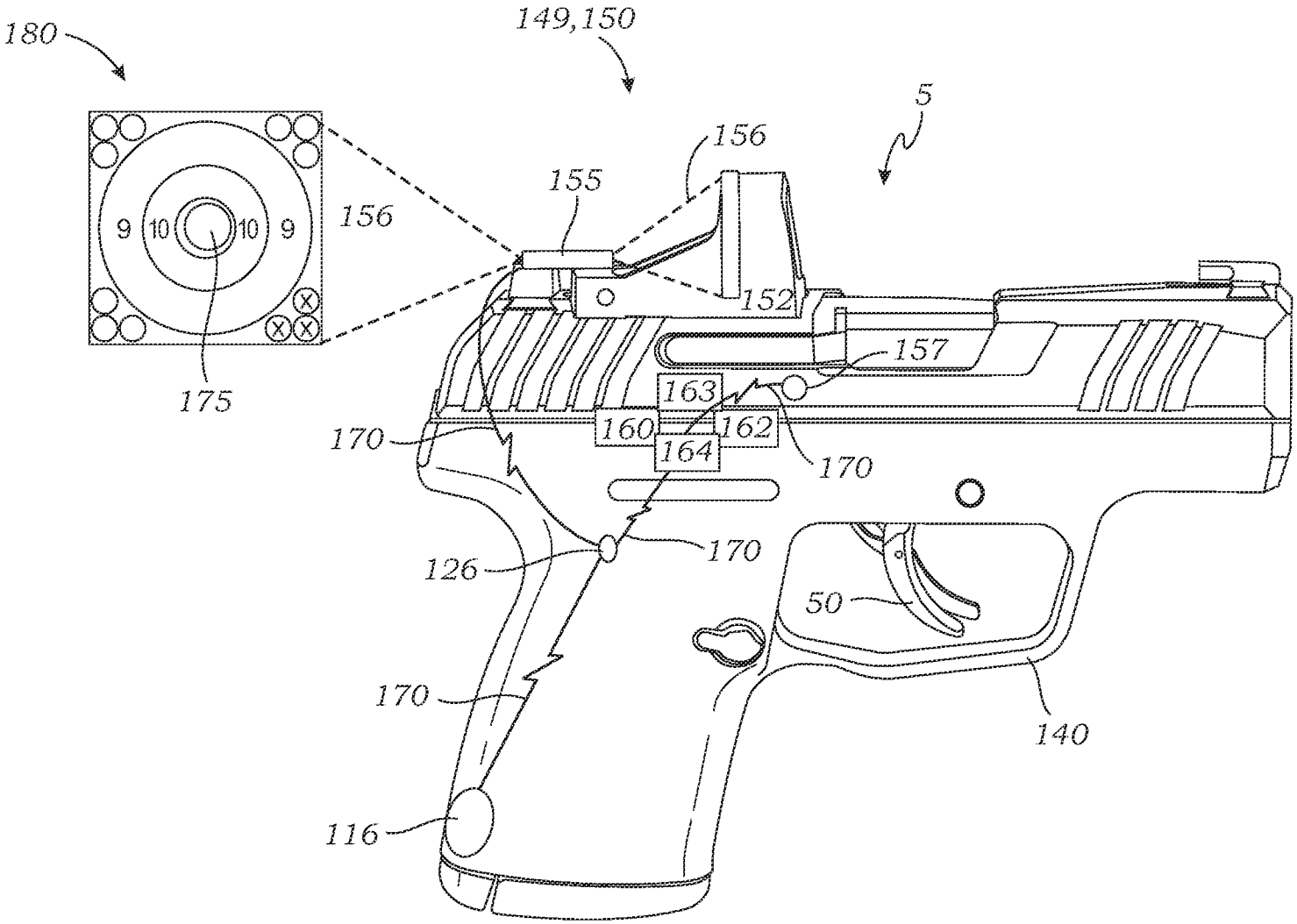
FIG. 7 shows a firearm optic positioning assembly operatively connected to a handgun in accordance with an embodiment disclosed herein.

FIG. 7 shows an example of a firearm optic positioning assembly 149 and more specifically a red dot positioning assembly 150 operatively connected to a firearm 5 in accordance with an embodiment disclosed herein. Optics utilized for firearms incorporate a variety of optic technologies including a scope, a low-powered variable optic (LPVO), a red dot sight, a reflex sight, a prism sight, and a holographic sight, as well as visual features to indicate that a firearm 5 is properly aimed at a target 180. These features include but are not limited to a reticle or crosshair of a various design or pattern, a red dot, a green dot, a circle, and circle dot. As used herein, the term "firearm optics positioning assembly" 149 is intended to include all the above-mentioned optic technologies and visual features. The terms "red dot optic" and "red dot" are intended to include the red dot sight, the reflex sight, the prism sight, and the holographic sight optics, as well as at least the red dot, green dot, circle, circle dot, or similar visual feature that aids the shooter in aiming the firearm 5.

The firearm optics positioning assembly 149 or red dot positioning assembly 150 includes electro-mechanical connectivity 170 between the power source 116, a power switch 126, an optic 152, a vision capture device 155, a storage device 160, a processor 162 having processor elements 164, a recognition circuit 163, and a cue device 157. The cue device 157 may be an audible device (e.g., a speaker or beeper), a visual device (e.g., an LED), or any other device sufficient to output a perceptible signal.

In one example, with an optic 152 mounted on the firearm 5 as may be the case with either the firearm optics positioning assembly 149 or red dot positioning assembly 150, while looking through a viewing plane of the optic 152, a shooter visually places a red dot 175 or visual features to indicate that a firearm 5 is properly aimed at a target 180 on an intended target 180. The firearm optics positioning assembly 149 or the red dot positioning assembly 150 includes a vision capture device 155 positioned on the firearm 5 to capture a field of view 156 as seen by the shooter through the optic 152. The field of view 156 as seen by the shooter when looking through the optic 152 is represented in FIG. 7 to the left of the vision capture device 155 as a red dot 175 positioned on the target 180. While a red dot 175 is represented it is understood that other visual features may include green dot, circle, circle dot, cross-hair or similar visual feature that aids the shooter in aiming, the firearm 5.

The vision capture device 155 may be for example, a camera or more particularly a fiber optic camera such as those used in the medical field, inspection, surveillance, etc. The vision capture device 155 may be connected directly with wires or wirelessly to a storage device 160 and processor 162 having processor elements 164. The vision capture device 155 is configured to view images, capture an image, and transmit the captured image to the storage device 160 and/or processor 162. Images captured are stored for later comparison to other images. In this regard, like well-known facial recognition systems, a recognition circuit 163 of the firearm optic positioning assembly 149 or red dot positioning assembly 150 includes: extracting information from a database (storage); comparing the information, for example a digital map of a field of view 156, with other information; and determining if the information from the database substantially matches the other information.

To populate the database, for example, the red dot 175 of the optic 152 is positioned on an intended target 180, as may be the case with a fixed target having a "bullseye." The vision capture device 155 is configured to capture one or more first images of the viewing field 156 of the optic 152. The viewing field 156 may be size to capture the entire viewing field or some portion of the entire viewing field. Capture of the first images may occur in a variety of ways including a push of a button, a swipe or tap of surface located on the vision capture device 155 or on the firearm 5, or a verbal command from the shooter. The captured image is sent to the storage device 160 and/or processer 162 having processor elements 164.

The processor 162 maps a fixed field of pixel locations corresponding to the red dot 175 positioned on the intended target 180, i.e., the viewing field 156 captured by the vision capture device 155, by using a known color/gray-scale pixel determination process including one or more processing elements 164 and program instructions for directing one or more processing elements with access to the storage device 160. The red dot 175 of the optic 152 may be interpreted as a white dot or other contrasting color from target the 180 to distinguish and map the field of pixel locations more accurately. The set of fixed field pixel locations is communicated and stored in the storage device 160 as database information.

Images appearing in the field of view 156 of the optic 152 during use of the firearm 5 are continually communicated to the processor 162 and processing elements 164 by the vision capture device 155. These images are compared by the recognition circuit 163 to the first image(s). When a viewing field 156 in the optic 152 matches or is within a preset or otherwise determined degree of precision of matching any of the first image(s) stored in memory (i.e., substantially the same), such conditions represent the red dot 175 being positioned on or within a predefined distance of the intended target 180 and accordingly an input is provided to the cue device 157 which then cues the shooter that the red dot 175 is on the target 180.

The first image of the field of view 156 may be removed or deleted from the storage device 160 in a similar manner as used to capture the first image. For example, if a single push of a button, a single swipe, single tap of surface located on the vision capture device 155 or on the firearm 5, or an oral command from the shooter is used to capture an image, a double button push, double swipe, double tap, or alternative oral command from the shooter may be used to remove or delete the first image of the field of view 156 stored in the storage device 160.

Accordingly, the firearm optic positioning assembly 149 is configured to capture multiple images of a field of view 156 of an optic 152 including a first image and generate a perceptible signal or cue 157 upon detection of a second image of the field of view 156 being substantially the same as the first image. The firearm optic positioning assembly 149 includes a power source 116, a visual capture device 155, a storage device 160, and a recognition circuit 163 operatively connected to each other, wherein the capture device 155 captures and transmits the first image to the storage device 160; the recognition circuit 163 compares the first image to subsequent images captured by the capture device 155; and the perceptible signal or cue 157 is generated upon detection of the second image being substantially the same as the first image. The firearm optic positioning assembly 149 further includes a processor 162 and processing elements 164 operatively connected, wherein the processor 162 maps a fixed field of pixel locations corresponding to the first image using program instructions for directing one or more of the processing elements 164; and the fixed field of pixel locations is communicated and stored in the storage device 160 for comparison to subsequent images captured by the capture device 155.

FIGS. 8A-8D show the firearm optic positioning assembly 149 or the red dot positioning assembly 150 of FIG. 7 in different arrangements as may be adapted for integration into various known red dot optics. As shown in FIGS. 8A-8D, known optics 152 are varied in design configuration, size, and attachment options including a mounting plate 166 and a riser 167. Accordingly, the integration of the red dot positioning assembly 150 into a known red dot optic depends on various factors. For example, known optics 152 utilize an internal power source to generate an optical beam that forms the red dot 175. With integration of the optic positioning assembly 149, a power source 116 may be utilized to power the red dot positioning assembly 150. Alternatively, the internal power source of the optic 152 may be configured to power the optic 152 and the optic positioning assembly 149.

Figures 8A, 8B, 8C, 8D:
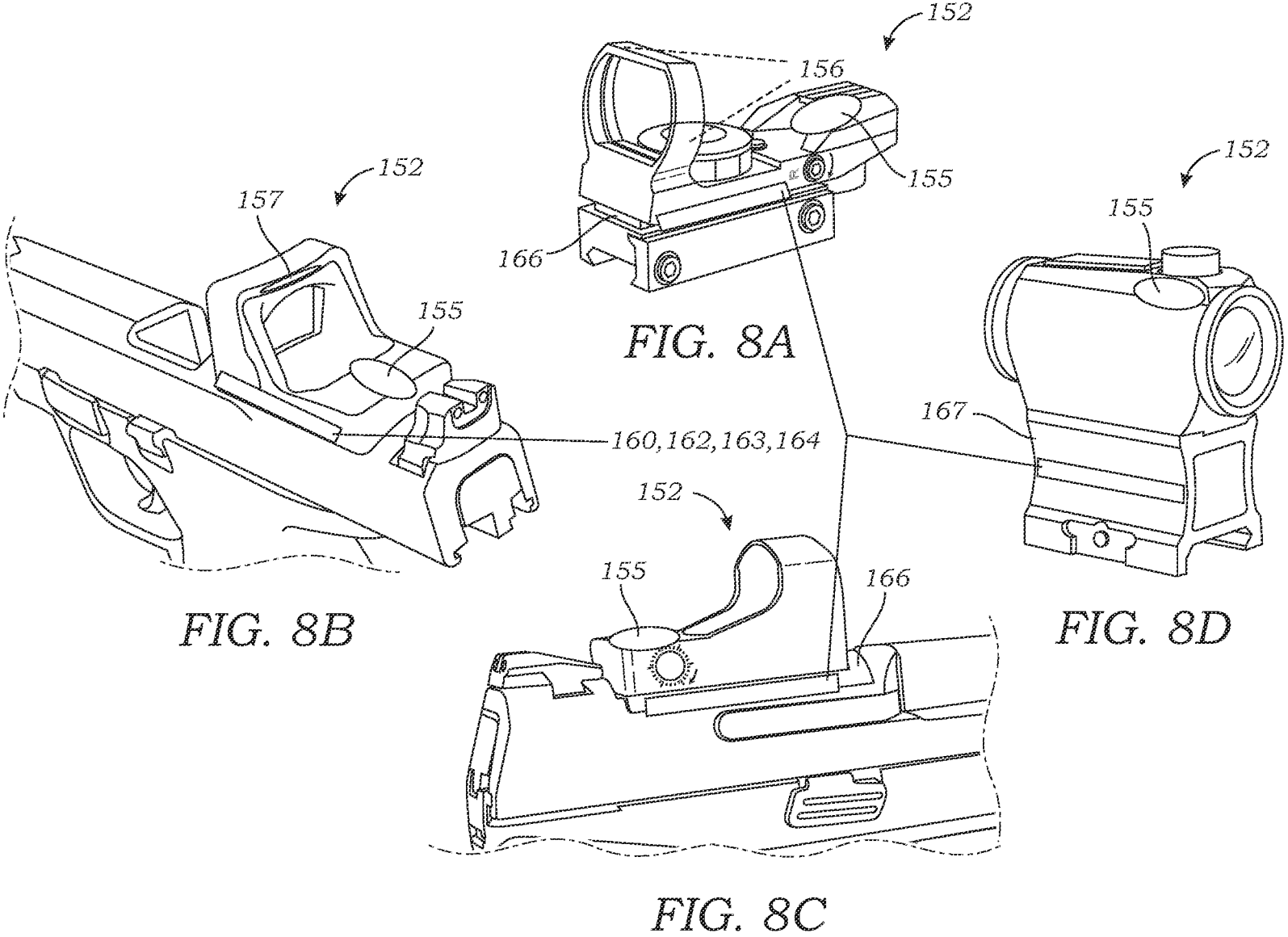
FIGS. 8A-8D show the firearm optic positioning assembly of FIG. 7 in different arrangements as may be adapted for integration into various known optics.

FIG. 8A shows the vision capture device 155 integrated into an optic 152 to capture a field of view 156. FIG. 8A further shows the storage device 160, processor 162, recognition circuit 163, and processor elements 164 as may be integrated into the housing of the optic 152 (FIG. 8B), the mounting plate 166 (FIGS. 8A and 8C), or the riser 167 (FIG. 8D) of the optic 152. FIG. 8B shows another optic 152 with integration of the vision capture device 155 and one example of the cue 157 formed as an LED band along an upper edge of the optic 152. In this regard, the cue 157 acts as a perceptible visual signal to affirm the red dot 175 is positioned on the target 180.

Figure 9:
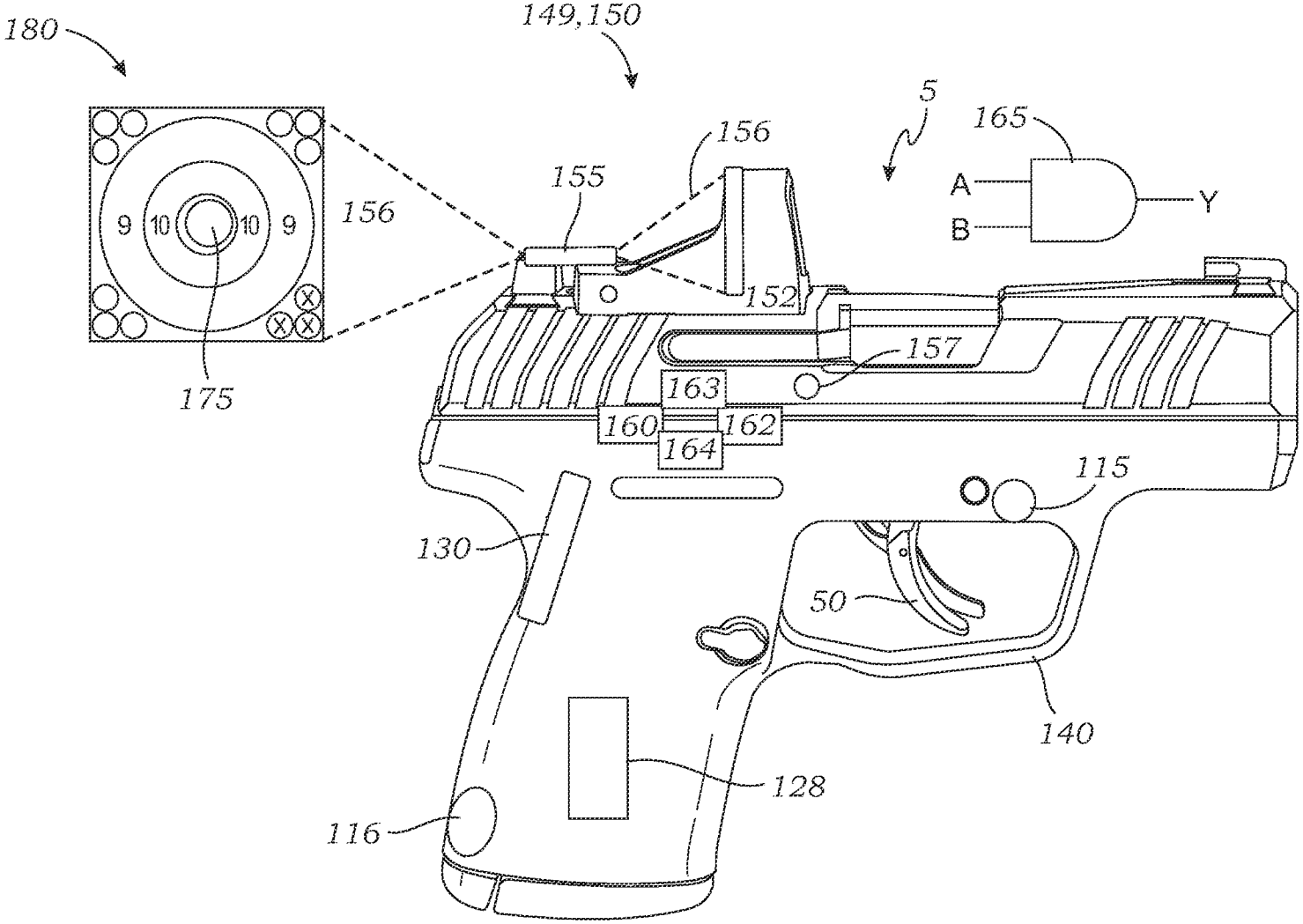
FIG. 9 shows a firearm optic positioning assembly and a firearm firing control system combination operatively connected to a handgun in accordance with an embodiment disclosed herein.

FIG. 9 shows a combination firearm optic positioning assembly 149 or red dot positioning assembly 150 and a firearm firing control assembly 110 operatively connected in a firearm firing control system 2 in accordance with an embodiment disclosed herein. The electromechanical connections 170 have been removed from FIG. 8 for clarity. The combined elements of the optic positioning assembly 149 and the firearm firing control assembly 110 operate generally as described with reference to FIG. 7 and FIG. 3 respectively, however a logic AND gate 165 is included and a multi-position power switch 128 replaces power switches 125 and 126.

Once first images are stored for later comparison to intended targets, firearm optic positioning assembly 149 operates in combination with the firearm firing control assembly 110 such that two conditions must be met for the actuation voltage to be sent to load 130. More specifically, load 130 is configured to receive an actuation voltage from power source 116 only upon both: i) detection of a second image of a field of view by the optic positioning assembly 149 and determination that the second image is substantially the same as one of the first images; and ii) detection of movement by touchless sensor 115.

This may be accomplished using an AND gate 165, with two inputs (shown as inputs A and B) and a single output (shown as output Y). In AND gate 165, if either of the inputs A or B is low (0), then the output Y is also low. In other words, both inputs A and B must be high (1) for output Y to be high.

Input A receives a high input (1) from storage device 160 only when a second image of viewing field 156 appearing in optic 152 substantially matches one of first images stored in storage device 160. Input B receives a high input (1) from sensor 115 when sensor 115 senses object movement, as previously described herein.

The output Y (voltage) of AND gate 165 is sent to and received by load 130. As described herein, that voltage will be high only if both inputs A and B are high, or in other words, only if: i) detection of a second image of a field of view 156 by the optic positioning assembly 149 and determination that the second image is substantially the same as one of the first images; and ii) detection of movement by touchless sensor 115.

Accordingly, when the red dot 175 is positioned on a target 180 substantially matching one of the first captured images, and sensor 115 detects an object 190, the firearm 5 will fire. In this regard, the combination of optic positioning assembly 149 and the firing control assembly 110 provides an enhanced level of shooting consistency and accuracy.

Figure 10:
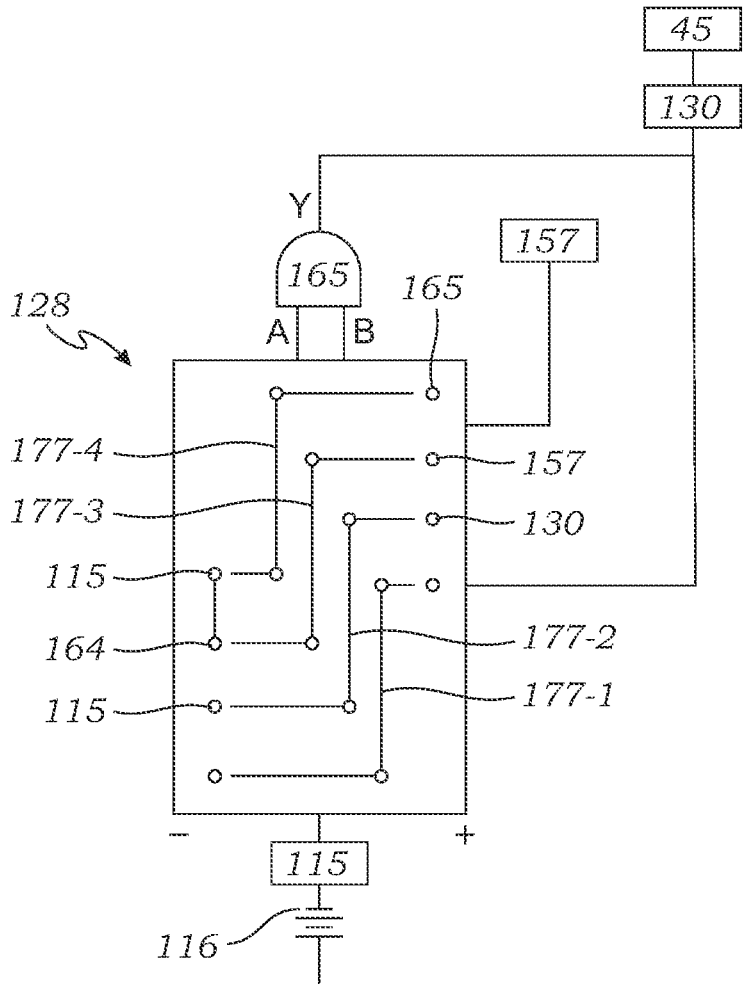
FIG. 10 shows a multi-position switch and circuit configuration of the firearm optic positioning assembly and a touchless sensor firing control assembly combination shown in FIG. 8 in accordance with an embodiment of the present invention.

FIG. 10 shows a multi-position switch 128 and a circuit configuration of the firearm optic positioning assembly 149 or the red dot positioning assembly 150 and the touchless sensor firearm firing control system 2 combination shown in FIG. 8 in accordance with an embodiment disclosed herein. The electro-mechanical connectivity connections include: an output Y of logic AND gate 165, the load 130, the power source 116, the capture device 155, the cue device 157, the storage device 160, the processor 162, the processor elements 164, and the recognition circuit 163. Additional connections include input A of the logic AND gate 165 from sensor 115, and input B of the logic AND gate 165 from the optic positioning assembly 149 or red dot positioning assembly 150. In the example shown in FIG. 9, the power source 116 supplies power directly to the sensor 115, and to the optic positioning assembly 149 or red dot positioning assembly 150 through the multi-position power switch 128. Depending on the intended operational applications, size limitations, and other considerations various circuit configurations may be employed.

In the embodiment shown in FIG. 9 and FIG. 10, multi-position power switch 128 is a four-position switch that offers separate and distinct selective activation and deactivation of the firing control assembly 110 and/or the firearm optic positioning assembly 149 or the red dot positioning assembly 150. With power switch 128 placed in a first position 177-1, no connections are made through the power switch 128 for either the firearm firing control assembly 110 or the optic positioning assembly 149. Accordingly, the firearm 5 may be operated in the traditional manner by pulling the trigger 50 and utilizing the back-up iron sights. With power switch 128 placed in a second position 177-2, the firearm firing control assembly 110 is activated and detection of an object 190 by sensor 115 will provide an actuation voltage to load 130 causing directional movement of the load 130 connected to the trigger bar 45 resulting in firing of the firearm. Accordingly, with power switch in the second position 177-2, the fireman 5 may be operated as described with reference to FIG. 3. With power switch 128 placed in a third position 177-3, the optic positioning assembly 149 is activated and the optics positioning assembly 149 operates to recognize field of view 156, capture, store, and process through processor elements 164 to provide a cue 157 as described with reference to FIG. 7. With power switch 128 in a fourth position 177-4, the firing control assembly 110 and the optic positioning assembly 149 are activated and the combination of firing control assembly 110 and optic positioning assembly 149 are used together and operate as described with reference to FIG. 8 to provide inputs to the logic AND gate 165, such that logic AND gate 165 outputs output Y to load 130.

The four positions of the multi-position power switch 128 and the corresponding activation of related elements has no effect on the operation of those assembly elements that are deactivated. Power switch 128 thus acts as a safety switch in that while activation of only the optic positioning assembly 149 may enhance shooting consistency and accuracy, activation of the optics positioning assembly 149 alone with power switch 128 in the third position 177-3 will not cause firing of the firearm 5 unless the trigger 50 is pulled in the traditional manner. In summary, the firing control assembly 110 and the optic positioning assembly 149 may be used together or separately to adapt to a variety of shooting needs or other requirements while enhancing shooting consistency and accuracy.

Firearm Sight Alignment and Cue Generation Assembly

Figure 11:
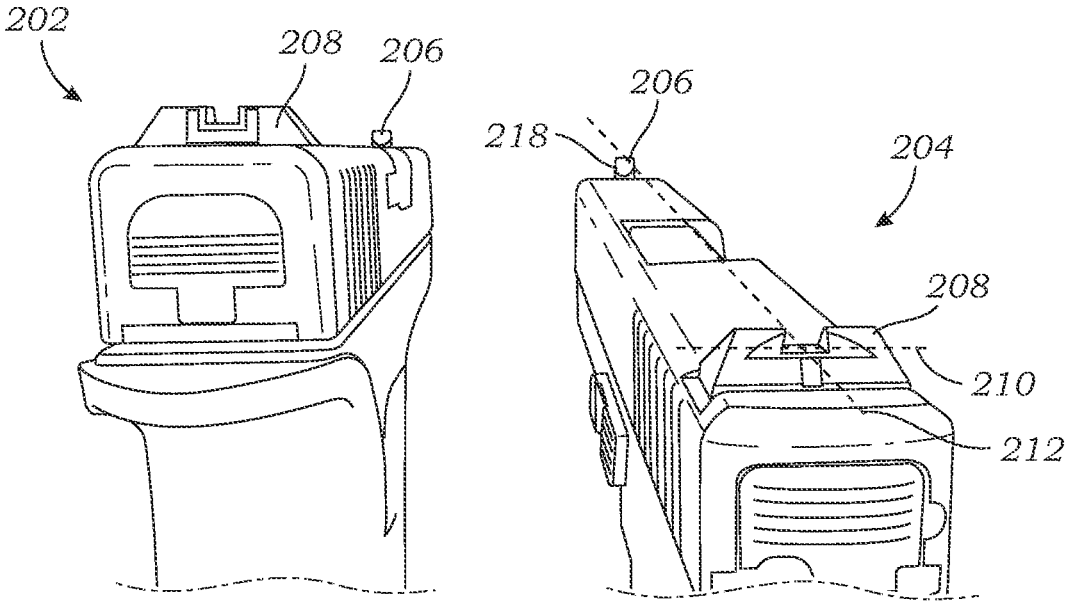
FIG. 11 shows a first beam and a second beam that intersects and bisects the first beam of a sight alignment with cue generation assembly in accordance with an embodiment disclosed herein.

FIG. 11 shows two firearms 202, 204 viewed from back to front with each having a front sight 206 and a rear sight 208 for sight alignment 220 of the firearm 202, 204. Also shown is a representation of a first alignment path 210 and a second alignment path 212 of the sight alignment and cue generation assembly 200. It is understood that the front sight and rear sight as shown in any of the figures are only representative of the many variations of firearm sights as they may differ in size, shape, configuration, indicia, and positioning on a firearm. Accordingly, while firearms, e.g., handgun, rifle, etc., may differ in physical size and the positioning of the rear sight relative to the front sight, the fundamental inventive concepts of a firearm sight alignment and cue generation assembly 200 (FIG. 12) disclosed are applicable to all types of firearms having a front sight and a rear sight.

Figure 12:
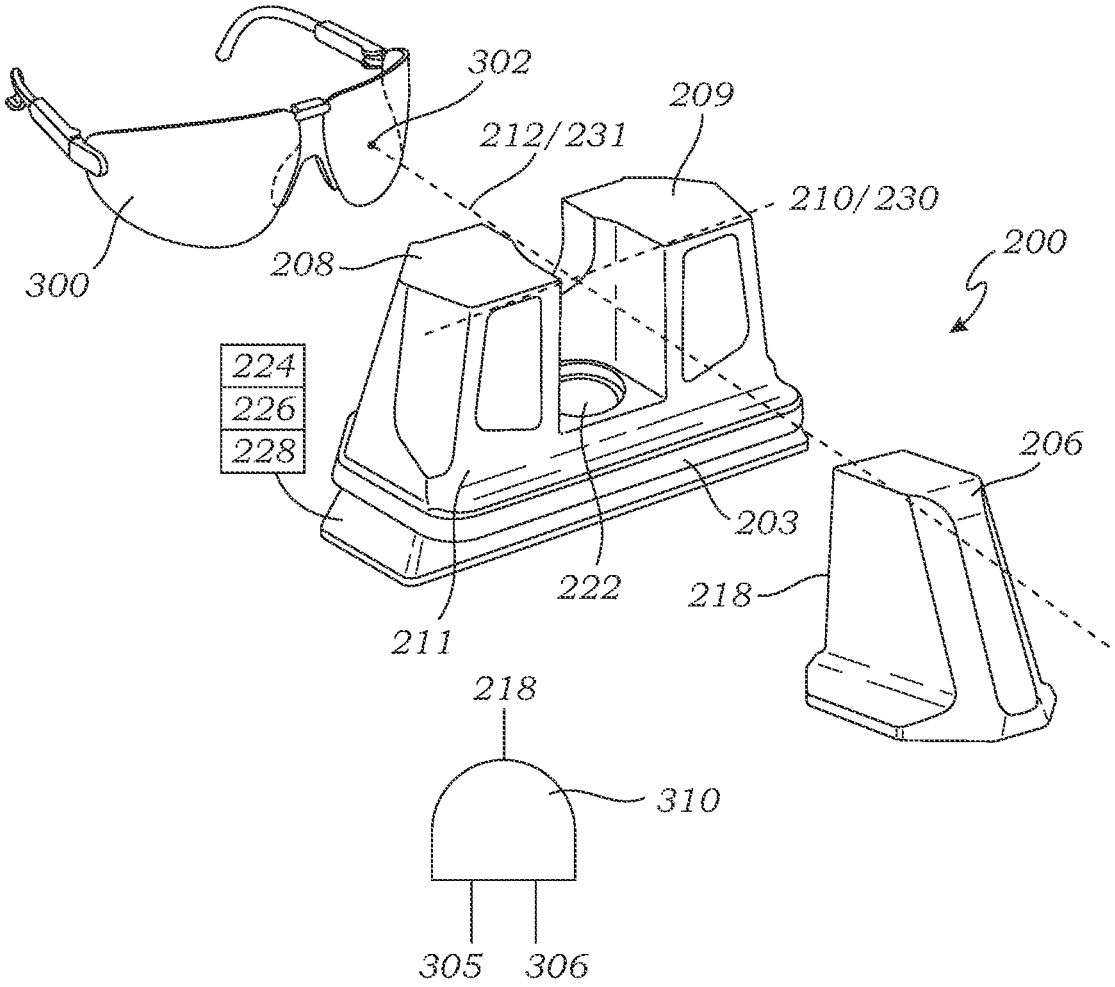
FIG. 12 shows a sight alignment with cue generation assembly in accordance with an embodiment disclosed herein.

FIG. 12 shows a front perspective view of the front sight 206, the rear sight 208, and a reference point 302, as well as various elements of the firearm sight alignment and cue generation assembly 200 to generate the first alignment path 210 and the second alignment path 212. The firearm sight alignment and cue generation assembly 200 includes the front sight 206, the reference point 302, and the rear sight 208 spaced between the front sight 206 and the reference point 302. The rear sight 208 includes a first post 209 and a second post 211 spaced apart from each other and configured to form the first alignment path 210. The front sight 206 is configured to form the second alignment path 212. A cue 218 is generated upon detection of sight alignment 220 (shown in FIG. 14) of the first alignment path 210, the second alignment path 212, and the reference point 302.

Figure 13:
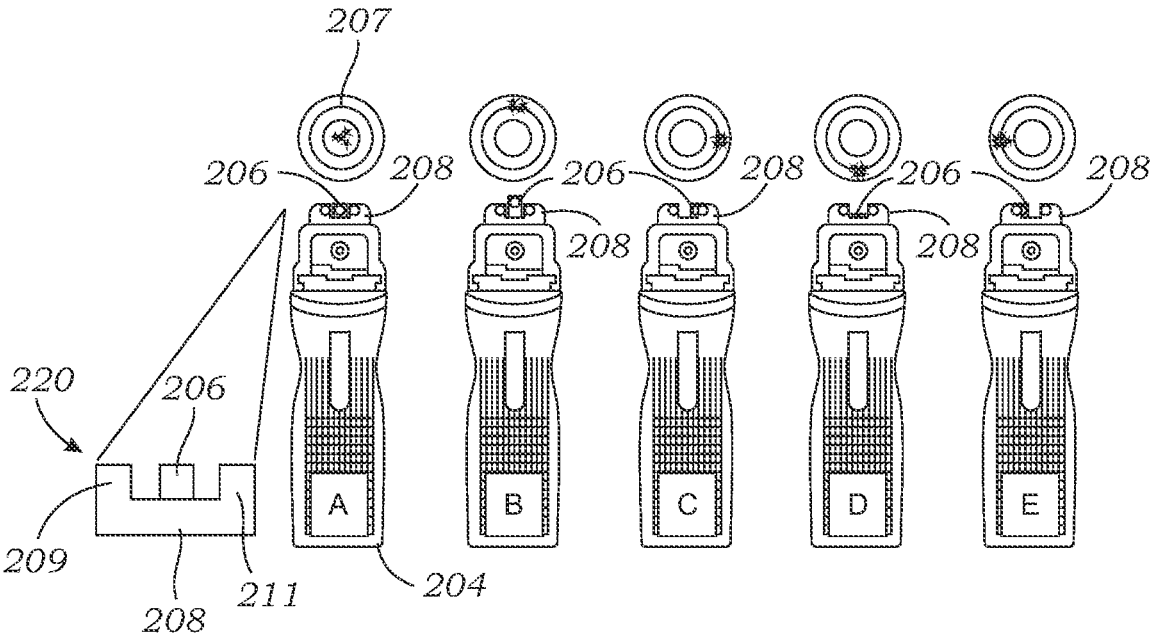
FIG. 13 shows sight alignment variations with a handgun having a front sight and a rear sight.

Sight alignment and sight picture have traditionally required alignment of the front sight and rear sight with each other, and alignment of the front sight on an intended target 207. The first alignment path 210 and the second alignment path 212 represent positioning of the front sight 206 relative to the rear sight 208 when viewed by a person looking from behind the rear sight 208 toward the front sight 206. FIG. 13 shows various positions of a rear sight 208 relative to a front sight 206 in sight alignment 220 of the firearm 204 as indicated by letters A-E on the handgrip of each firearm 204. As shown in "A" of FIG. 13, sight alignment 220 is achieved when the front sight 206 is positioned evenly between the first post 209 and the second post 211 of the rear sight 208 and is level with the rear sight 208 when viewed looking from behind the rear sight 208 toward the front sight 206. In this regard, the viewpoint is represented by the shooter's eye. As such, sight alignment 220 is achieved when the shooter's eye is properly positioned so that the shooter views the front sight 206 position between and level with the first post 209 and second post 211 of the rear sight 208.

Figure 14:
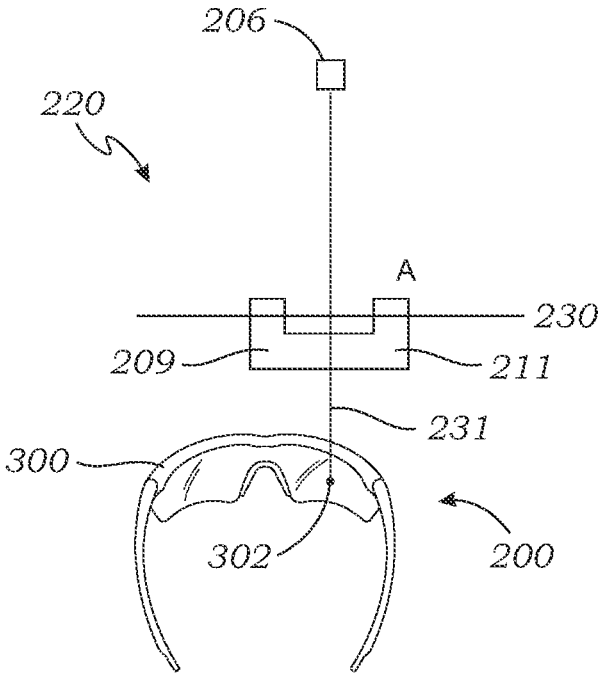
FIG. 14 shows the sight alignment with cue generation assembly in accordance with an embodiment disclosed herein.
Figure 15:
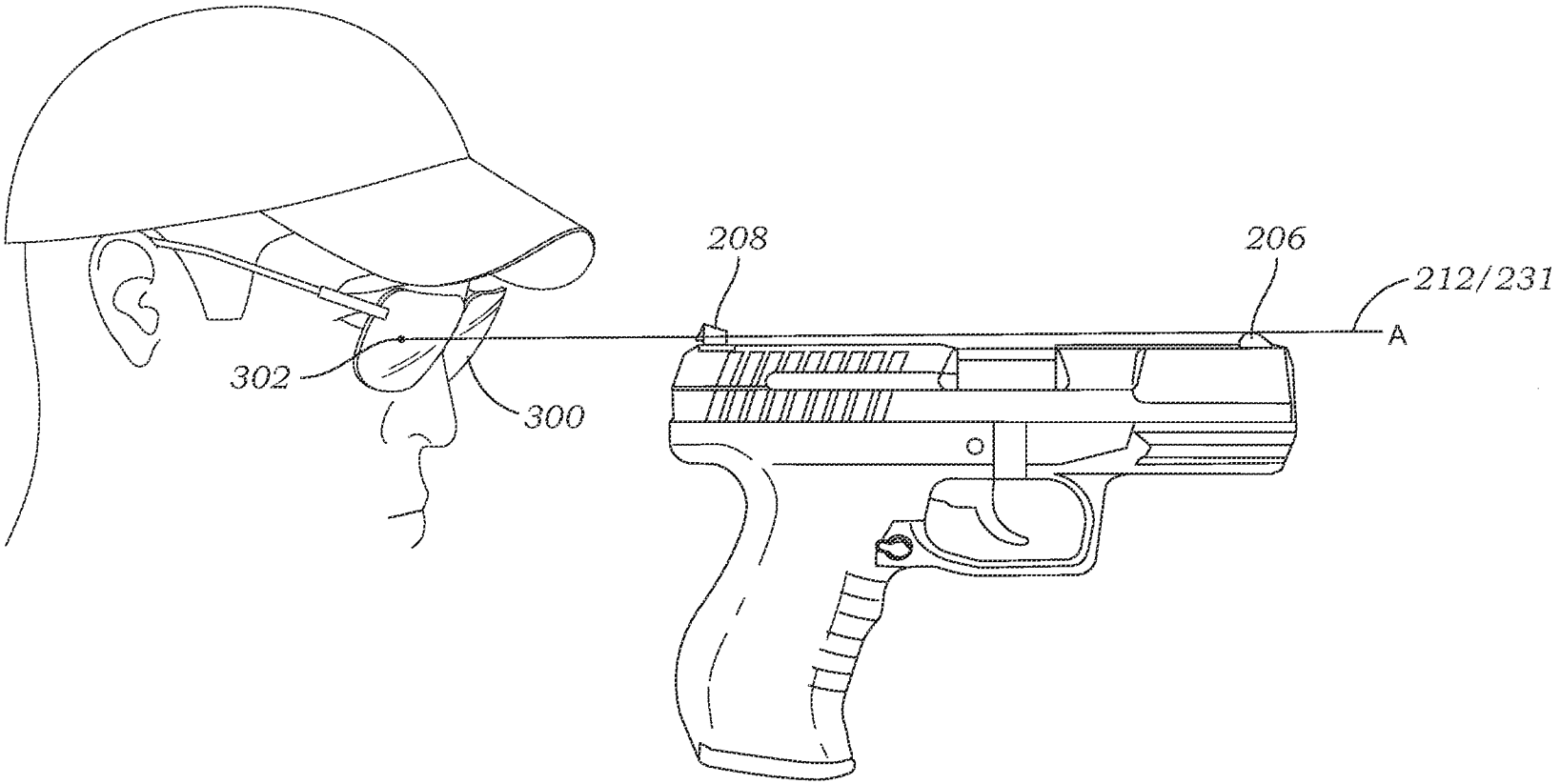
FIG. 15 shows the sight alignment with cue generation assembly in accordance with an embodiment disclosed herein.

This positioning is sometimes referred to as even "light" and even "height". In other words, when the front sight 206 is positioned between the first post 209 and second post 211 of the rear sight 208, there is even spacing or "light" between the front sight 206 and each of the first post 209 and the second post 211 of the rear sight 208, and the front sight 206 is at the same "height" as the rear sight 208. As shown in FIG. 12 and FIG. 14, sight alignment 220 of the firearm sight alignment and cue generation assembly 200 is achieved when the second alignment path 212 (formed by a second beam 231) from the front sight 206 to the reference point 302 insects and bisects the first alignment path 210 (formed by a first beam 230) formed between the first post 209 and the second post 211 of the rear sight 208. The second alignment path 212 formed by the second beam 231 from the front sight 206 to the reference point 302 is further shown in FIG. 15 when viewed from the side of the firearm. Accordingly, sight alignment 220 is achieved when the second beam 231 contacts the reference point 302 and intersect and bisects the first beam 230. The action of sight picture, i.e., positioning of the aligned sights 206, 208 on the target 207, is dependent on the shooter.

The first beam 230 and the second beam 231 may be an infrared or other suitable light source invisible to the eye. Shooters are required to wear eye protection while shooting a firearm. FIG. 12 shows eye protection such as glasses or similar eyewear 300 having the reference point 302 positioned on the glasses 300 and the glasses 300 spaced apart from the rear sight 208. The reference point 302 is representative of the positioning of a shooter's eye and therefore represents a person's point of view when looking from behind the rear sight 208 toward the front sight 206. The reference point 302 is a section or area on the glasses 300 configured and sized appropriately to allow the shooter to view the sights 206, 208, and permit the reference point 302 to either reflect the second beam/light source 231 or otherwise cause the firearm sight alignment and cue generation assembly 200 to illicit a response when the second beam/light source 231 contacts the reference point 302. If needed, the glasses 300 may be coated with a film or layer to shield or otherwise protect the person's eyes from the second beam 231 while permitting visibility of the intended target 207.

Letters B-E on the handgrips of respective firearms 204 of FIG. 13 show improper or misalignment in the positioning of the front sight 206 relative to the rear sight 208 from the viewpoint of the shooter. Letter C shows positioning of the front sight 206 too far to the right of the rear sight 208. Likewise, letter E shows positioning of the front sight 206 too far to the left of the rear sight 208. Letter B shows an example of when the front sight 206 is positioned too high relative to the rear sight 208. Finally, letter D shows an example of when the front sight 206 is positioned too low relative to the rear sight 208.

A power source 222 (battery including AA, AAA, lithium, or other suitable power source), a beam generator 224, and a processor 226 and processing elements 228 including storage and memory capacity are operatively connected to each other. One of more of these elements may be enclosed or formed as part of a housing 203 of the rear sight 208. Alternatively, one or more of the elements may be positioned external to the rear sight 208. The beam generator 224 receives power from the power source 222 and generates the first beam 230 representing the first alignment path 210 between the first post 209 and second post 211 of the rear sight 208. In this regard, the rear sight 208 is configured to transmit the first beam 230 from either the first post 209 to the second post 211 or from the second post 211 to the first post 209. The beam generator 224 further generates the second beam 231 representing the second alignment path 212 from the front sight 206. In this regard, the front sight 206 is configured to transmit the second beam 231. The firearm sight alignment and cue generation assembly 200 may include a power switch (not shown) to selectively apply or remove power from the beam generator 224.

Alignment of the front sight 206 relative to the rear sight 208 to cause the second beam 231 to intersect and bisect the first beam 230 may be preset by a manufacturer or by a person adding or replacing the front sight 206 or the rear sight 208 or both sights 206, 208. In this manner, when the second beam 231 intersects and bisects the first beam 230, the processor 226 and processing elements 228 sense the contact of the second beam 231 with the first beam 230 and generates a first digital response or affirmation signal 305. When the second beam 231 contacts the reference point 302 the processor 226 and processing elements 228 sense the contact of the second beam 231 with the reference point 302 and generates a second digital response or affirmation signal 306. When both the first digital response 305 and second digital response 306 are generated indicating sight alignment 220 of the first alignment path 210 (first beam 230), the second alignment path 212 (second beam 231), and the reference point 302, the processor 226 and processing elements 228 generate the cue 218. The term "intersect" is intended to mean that contact is made, i.e., one beam contacts the other beam, and the term "bisect" is intended to mean a midpoint or equal distance, i.e., one beam is between the other beam. An acceptable deviation tolerance for sight alignment may be designated or programmed into the firearm sight alignment and cue generation assembly 200, i.e., some plus or minus degree of variation in what constitutes "intersect" and bisect".

As shown in FIG. 12, generation of the cue 218 may be accomplished using an AND gate 310, with two inputs of the AND gate 310 shown as digital response inputs 305 and 306 and a single output shown as cue output 218. In AND gate 310, if either of the first digital response input 305 or second digital response input 306 is low (0), then the cue output 218 is also low. In other words, both inputs 305, 306 must be high (1) for the cue output 218 to be high.

The processor 226 and processing elements 228 including storage and memory capacity are connected to receive data regarding the alignment or positioning of the first beam 230 and the second beam 231 that form the first alignment path 210 and the second alignment path 212 respectively. When the second alignment path 212 (second beam 231) intersect and bisects the first alignment path 210 (first beam 230) the data is captured and stored in memory. The stored data represents the first digital response 305 when the second beam 231 intersects and bisects the first beam 230. When reference point 302 is positioned to receive or contact the second beam 231, sight alignment 220 is achieved and the processor 226 and processing elements 228 generate the cue 218. As such, the processor 226 and processing elements 228 generating a cue 218 upon detection of sight alignment 220 of the first alignment path 210 (first beam 230), the second alignment path 212 (second beam 231), and the reference point 302.

The cue 218 may take the form of any audible or visual feedback to cue the shooter that sight alignment 220 has been achieved. For example, the front sight 206 may change in color from white or black to green or red, or a sound may be emitted from the rear sight 208 or some portion of the firearm to notify the shooter that sight alignment 220 has been achieved. These cues may be generated with a small speaker or tone generator in the case of an audio cue or an LED light in the case of a visual cue.

If sight alignment 220 is achieved, the functionality of the firearm sight alignment and cue generation assembly 200 is not affected by the positioning of firearm. In this regard, as sight alignment 220 is dependent on the positioning of front sight 206, rear sight 208, and reference point 302 the firearm may be held at any angle and if sight alignment 220 is achieved the firearm sight alignment and cue generation assembly 200 will generate a cue 218 to alert the shooter. As such, the firearm sight alignment and cue generation assembly 200 provides a safe, effective, and consistent sight alignment to improve shooting accuracy.

The apparatus and methods of the claimed subject matter have been described with some particularity, but the specific designs, constructions and steps disclosed are not to be taken as delimiting of the subject matter. Obvious modifications will make themselves apparent to those of ordinary skill in the art, all of which will not depart from the essence of the claimed subject matter and all such changes and modifications are intended to be encompassed within the appended claims.

What is claimed is:

1. A firearm firing control system comprising:

a power source;

a load mechanically connected to a trigger assembly of a firearm and configured to be actuated by an actuation voltage from the power source; and a firearm optic positioning assembly configured to be operatively connected to the firearm to capture multiple images of a field of view;

wherein the load is configured to receive the actuation voltage upon detection of a second image of a field of view by the firearm optic positioning assembly, comparison of the second image to the first image, and determination that the second image is substantially the same as the first image to cause actuation of the trigger assembly in response thereto.

2. The firearm optic positioning assembly of claim 1 comprising:

the power source, a visual capture device, a storage device, and a recognition circuit operatively connected to each other, wherein the capture device captures and transmits the first image to the storage device; the recognition circuit compares the first image to subsequent images captured by the capture device; and the actuation voltage is generated upon detection of the second image being substantially the same as the first image.

3. The firearm optic positioning assembly of claim 2, further comprising:

a processor and processing elements operatively connected, wherein the processor maps a fixed field of pixel locations corresponding to the first image using program instructions for directing one or more of the processing elements; and the fixed field of pixel locations is communicated and stored in the storage device for comparison to subsequent images captured by the capture device.

4. The firearm optic positioning assembly of claim 2, wherein the visual capture device is a camera, and the firearm optic is one of a scope, a red dot sight, a reflex sight, a prism sight, a low-powered variable optic, or a holographic sight.

5. The system of claim 1, further comprising a power switch for selective activation and deactivation of the power source.

6. The system of claim 1, in combination with a firearm, wherein the load is mechanically connected to a trigger assembly of the firearm such that actuation of the load actuates a firing pin of the firearm.

7. The system of claim 6, wherein the load is a linkage mechanically connected to a trigger bar of the trigger assembly such that actuation of the load releases the trigger bar whereby a firing pin is actuated.

8. A firearm firing control system comprising:

a power source;

a load mechanically connected to a trigger assembly of a firearm and configured to be actuated by an actuation voltage from the power source; and a firearm optic positioning assembly configured to be operatively connected to the firearm to capture multiple images of a field of view including a first image and a second image;

wherein the load is configured to receive the actuation voltage upon comparison of the second image to the first image, and determination that the second image is substantially the same as the first image to cause actuation of the trigger assembly in response thereto.

9. The firearm optic positioning assembly of claim 8, comprising:

the power source, a visual capture device, a storage device, and a recognition circuit operatively connected to each other, wherein the capture device captures and transmits the first image to the storage device; the recognition circuit compares the first image to subsequent images captured by the capture device; and the actuation voltage is generated upon detection of the second image being substantially the same as the first image.

10. The firearm optic positioning assembly of claim 9, further comprising:

a processor and processing elements operatively connected, wherein the processor maps a fixed field of pixel locations corresponding to the first image using program instructions for directing one or more of the processing elements; and the fixed field of pixel locations is communicated and stored in the storage device for comparison to subsequent images captured by the capture device.

11. The firearm optic positioning assembly of claim 9, wherein the visual capture device is a camera, and the firearm optic is one of a scope, a red dot sight, a reflex sight, a prism sight, a low-powered variable optic, or a holographic sight.

12. The system of claim 8, further comprising a power switch for selective activation and deactivation of the power source.

13. The system of claim 8, in combination with a firearm, wherein the load is mechanically connected to a trigger assembly of the firearm such that actuation of the load actuates a firing pin of the firearm.

14. The system of claim 13, wherein the load is a linkage mechanically connected to a trigger bar of the trigger assembly such that actuation of the load releases the trigger bar whereby a firing pin is actuated.

* * * * *